US011161168B2

(12) United States Patent
Yabunaka et al.

(10) Patent No.: US 11,161,168 B2
(45) Date of Patent: Nov. 2, 2021

(54) FASTENING TOOL

(71) Applicant: MAKITA CORPORATION, Anjo (JP)

(72) Inventors: Toshihito Yabunaka, Anjo (JP); Hiroki Ikuta, Anjo (JP); Takao Kuroyanagi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 63 days.

(21) Appl. No.: 16/624,232

(22) PCT Filed: Jun. 8, 2018

(86) PCT No.: PCT/JP2018/022119
§ 371 (c)(1),
(2) Date: Dec. 18, 2019

(87) PCT Pub. No.: WO2018/235641
PCT Pub. Date: Dec. 27, 2018

(65) Prior Publication Data

US 2020/0130047 A1 Apr. 30, 2020

(30) Foreign Application Priority Data

Jun. 19, 2017 (JP) ..... JP2017-119969
Jun. 19, 2017 (JP) ..... JP2017-119971

(51) Int. Cl.
*B21J 15/26* (2006.01)
*B21J 15/10* (2006.01)
(Continued)

(52) U.S. Cl.
CPC ..... *B21J 15/26* (2013.01); *B21J 15/105* (2013.01)

(58) Field of Classification Search
CPC ..... B21J 15/26; B21J 15/326; B21J 15/105; B21J 15/043
See application file for complete search history.

(56) References Cited

U.S. PATENT DOCUMENTS 3,838,588 A * 10/1974 Johnson ..... B25B 27/0014 72/114
5,131,255 A * 7/1992 Fushiya ..... B21J 15/022 29/243.526
(Continued)

FOREIGN PATENT DOCUMENTS

CN 101 579 717 A 11/2009
CN 104 858 351 A 8/2015
(Continued)

OTHER PUBLICATIONS

Hou, Weiping; Electric Blind Riveting Tool; Dec. 14, 2016; EPO English Machine Translation; pp. 1-4 (Year: 2021).*
(Continued)

*Primary Examiner* — Bayan Salone
(74) *Attorney, Agent, or Firm* — Oliff PLC

(57) ABSTRACT

A fastening tool includes a housing, a fastener-abutment part, a pin-gripping part, a motor, a driving mechanism and a handle. The housing extends in a front-rear direction along a driving axis. The driving mechanism is configured to move the pin-gripping part rearward along the driving axis relative to the fastener-abutment part. The driving mechanism includes a rotary member and a movable member configured to linearly move in the front-rear direction when the rotary member is rotationally driven. The handle protrudes downward from the housing and has a trigger. A rotation axis of a motor shaft extends in parallel to the driving axis on a lower side of the driving axis. A virtual plane including the driving axis and the rotation axis passes a center of the handle in a left-right direction. The trigger is disposed between the rotary member and a motor body in the front-rear direction.

9 Claims, 10 Drawing Sheets

(51) Int. Cl.
*B21J 15/32* (2006.01)
*B21J 15/04* (2006.01)

(56) References Cited

U.S. PATENT DOCUMENTS

| | | | | | |
|---|---|---|---|---|---|
| 5,473,805 | A * | 12/1995 | Wille | B21J 15/26 | 29/243.526 |
| 6,237,390 | B1 * | 5/2001 | Honsel | B21J 15/043 | 29/243.526 |
| 8,109,123 | B2 * | 2/2012 | Chen | B21J 15/105 | 72/21.1 |
| 8,459,658 | B2 * | 6/2013 | Cycon | B25D 17/088 | 279/19.6 |
| 9,180,510 | B2 * | 11/2015 | Sugata | B21J 15/26 | |
| 9,339,865 | B2 * | 5/2016 | Skolaude | B21J 15/28 | |
| 9,849,502 | B2 * | 12/2017 | Gaertner | B21J 15/26 | |
| 2009/0145620 | A1 * | 6/2009 | Cycon | B25D 17/06 | 173/201 |
| 2010/0139067 | A1 * | 6/2010 | Chen | B21J 15/26 | 29/243.521 |
| 2014/0033505 | A1 * | 2/2014 | Skolaude | B21J 15/28 | 29/512 |
| 2015/0033525 | A1 * | 2/2015 | Sugata | B21J 15/105 | 29/243.526 |
| 2015/0336159 | A1 * | 11/2015 | Gaertner | B21J 15/26 | 29/525.06 |

FOREIGN PATENT DOCUMENTS

| | | | | | |
|---|---|---|---|---|---|
| CN | 204 565 044 | U | | 8/2015 | |
| CN | 204565044 | U | * | 8/2015 | B21J 15/105 |
| CN | 204819308 | U | | 12/2015 | |
| CN | 205798316 | U | * | 12/2016 | B21J 15/326 |
| CN | 205798316 | U | | 12/2016 | |
| EP | 0 527 414 | A1 | | 2/1993 | |
| EP | 0 953 390 | A2 | | 11/1999 | |
| JP | H05-200476 | A | | 8/1993 | |
| JP | 4005406 | B2 | | 11/2007 | |
| JP | 2013-173148 | A | | 9/2013 | |
| JP | 2014-172145 | A | | 9/2014 | |

OTHER PUBLICATIONS

Sep. 2, 2020 Office Action issued in Chinese Patent Application No. 201880040388.4.

Feb. 8, 2021 Extended Search Report issued in European Patent Application No. 18821549.5.

Aug. 25, 2020 Office Action issued in Japanese Patent Application No. 2017-119969.

Sep. 11, 2018 International Search Report issued in International Patent Application No. PCT/JP2018/022119.

Apr. 20, 2021 Office Action issued in Chinese Patent Application No. 201880040388.4.

* cited by examiner

FASTENING TOOL

TECHNICAL FIELD

The present invention relates to a fastening tool which fastens a workpiece via a fastener.

BACKGROUND ART

A fastening tool is known which fastens a plurality of workpieces via a fastener having a pin and a cylindrical part. As the fastener, a so-called blind rivet and a so-called multi-piece swage type fastener may be used. The blind rivet is a fastener of a type having a pin and a cylindrical part (also referred to as a rivet body or a sleeve) which are formed integrally with each other. The multi-piece swage type fastener is a fastener of a type having a pin and a cylindrical part (also referred to as a collar) which are formed separately from each other.

For example, Japanese laid-open patent publication No. 2013-173148 discloses a fastening tool for a blind rivet. This fastening tool is configured to swage a cylindrical part by a feed-screw mechanism pulling a pin gripped by a jaw out of the cylindrical part along a specified axis.

SUMMARY OF THE INVENTION

Problems to be Solved by the Invention

In the above-described fastening tool, an electric motor for driving the feed-screw mechanism is disposed in a position displaced from a region between a handle gripping position and the feed-screw mechanism in a circumferential direction around the axis. More specifically, when viewed from the rear, the feed-screw mechanism is aligned, in the up-down direction, with a center line of the handle, while the electric motor is disposed in a position displaced to the right from the center line. Therefore, operability may be lowered due to the weight imbalance in the left-right direction.

Accordingly, considering such circumstances, it is an object of the present invention to provide a technique which may help improve operability of a fastening tool.

Means for Solving the Problem

According to one aspect of the invention, a fastening tool is provided which is configured to fasten a workpiece via a fastener having a pin and a cylindrical part. The fastening tool includes a housing, a fastener-abutment part, a pin-gripping part, a motor, a driving mechanism and a handle.

The housing extends in a front-rear direction of the fastening tool along a specified driving axis. The fastener-abutment part is held by a front end portion of the housing so as to be capable of abutting on the cylindrical part of the fastener. The pin-gripping part is held to be movable in the front-rear direction along the driving axis relative to the fastener-abutment part and configured to grip a portion of the pin of the fastener. The motor is housed in the housing. Further, the motor includes a motor body and a motor shaft. The motor body includes a stator and a rotor. The motor shaft extends from the rotor.

The driving mechanism is at least partially housed in the housing. The driving mechanism is configured to be driven by power of the motor and configured to move the pin-gripping part rearward along the driving axis relative to the fastener-abutment part to pull the pin gripped by the pin-gripping part and deform the cylindrical part abutting on the fastener-abutment part, thereby fastening the workpiece via the fastener. The handle protrudes downward from the housing in an up-down direction, which is orthogonal to the front-rear direction. Further, the handle has a trigger which is provided in an upper end portion of the handle and configured to be depressed by a user. The driving mechanism includes a rotary member and a movable member. The rotary member is supported by the housing so as to be rotatable around the driving axis while its movement in the front-rear direction is restricted. The rotary member is configured to be rotationally driven by the power of the motor. The movable member is connected to the pin-gripping part. Further, the movable member is configured to be engaged with the rotary member so as to be movable in the front-rear direction along the driving axis while its rotation around the driving axis is restricted, thereby linearly moving in the front-rear direction when the rotary member is rotationally driven.

In the fastening tool of the present aspect, a rotation axis of the motor shaft extends in parallel to the driving axis on a lower side of the driving axis. A virtual plane including the driving axis and the rotation axis passes a center of the handle in a left-right direction, which is orthogonal to the front-rear direction and the up-down direction. Further, the trigger is disposed between the rotary member and the motor body in the front-rear direction. As for the phrase "the trigger is disposed between the rotary member and the motor body" herein, it may be sufficient if the trigger is at least partially disposed between a rear end portion of the rotary member and a front end portion of the motor body.

In the fastening tool of the present aspect, the driving mechanism may move the pin-gripping part in the front-rear direction relative to the fastener-abutment part. The driving mechanism includes the rotary member configured to be rotationally driven by the power of the motor and the movable member configured to linearly move in the front-rear direction when the rotary member is rotationally driven. Further, the arrangement relation among the motor, the driving mechanism and the handle is set such that the virtual plane including the driving axis and the rotation axis of the motor shaft which are arranged in parallel in the up-down direction passes the center of the handle in the left-right direction. In other words, the rotary member, the movable member, the motor and the handle are arranged in left-right symmetry (in plane symmetry relative to the above-described virtual plane). Thus, an excellent weight balance can be realized in the left-right direction, so that operability of the fastening tool can be improved. Further, in regard to the front-rear direction, since the motor is not arranged coaxially with the driving mechanism, the housing can be reduced in size in the front-rear direction. Furthermore, since the trigger is disposed between the rotary member and the motor body which are relatively heavy, an excellent weight balance can also be realized in the front-rear direction, so that operability of the fastening tool can be improved.

Examples of the fastener which can be used for the fastening tool of the present aspect may include a so-called blind rivet and a multi-piece swage type fastener.

In a blind rivet, the pin and the cylindrical part (also referred to as a rivet body or a sleeve) are integrally formed with each other. A flange may be integrally formed on one end of the cylindrical part. Typically, a shaft part of the pin may extend through the cylindrical part. The shaft part of the pin may protrude long from one end of the cylindrical part on which the flange is formed and a head may protrude adjacent to the other end of the cylindrical part. The blind rivet is a fastener of a type which can clamp a workpiece between one end portion (flange) of the cylindrical part and the other end portion of the cylindrical part which is deformed to be enlarged in diameter by the pin being pulled in an axial direction. In a multi-piece swage type fastener, the pin and the cylindrical part (also referred to as a collar) through which the pin is inserted are originally formed separately from each other. The multi-piece swage type fastener is a fastener of a type which can clamp a workpiece between a head of the pin and the cylindrical part swaged to a shaft part of the pin.

In a case where the blind rivet is used, a portion of the pin (also referred to as a pintail or mandrel) is finally torn off and separated at a small-diameter part for breakage by fastening operation. On the other hand, the multi-piece swage type fastener includes a fastener of the type in which the pintail is torn off like in the blind rivet, and a fastener of the type in which the shaft part is retained as it is. In use of the fastener of either type, the pin is moved relative to the cylindrical part by a fastening mechanism so that a workpiece is fastened with the fastener.

The housing may also be referred to as a tool body. The housing may be formed by connecting a plurality of parts. Further, the housing may have a one-layer structure or a two-layer structure.

The motor may be a direct current (DC) motor or an alternate current (AC) motor. The presence or absence of a brush is not particularly limited. However, a brushless DC motor may be preferably adopted since it is compact and has high output.

The structure of the fastener-abutment part is not particularly limited, as long as the fastener-abutment part is capable of abutting on the cylindrical part of the fastener. For example, in a case where the blind rivet is used, the fastener-abutment part may be configured to abut on and press the flange of the cylindrical part (rivet body or sleeve). Further, for example, in a case where the multi-piece swage type fastener is used, the fastener-abutment part may be configured to be engaged with the cylindrical part (collar) to thereby deform the cylindrical part by a swaging force. In the both cases, any known structure can be employed. The fastener-abutment part may be typically configured as a cylindrical body. The fastener-abutment part may be held by a housing by being connected to the housing directly or via a different member. It is noted that the fastener-abutment part may be configured to be detachable from the housing.

The structure of the pin-gripping part is not particularly limited, as long as the pin-gripping part is held to be movable in the front-rear direction along the driving axis relative to the fastener-abutment part and configured to grip a portion of the pin. For example, in either case of using the blind rivet or the multi-piece swage type fastener, any known structure can be employed which includes a jaw having a plurality of claws configured to grip a portion of a pin (specifically, a shaft part of the pin) and a jaw-holding part (also referred to as a jaw case). Typically, the pin-gripping part may be disposed coaxially with the cylindrical fastener-abutment part within the fastener-abutment part. It is noted that the pin-gripping part may be configured to be detachable from the housing.

As the driving mechanism, for example, a feed-screw mechanism or a ball-screw mechanism may be suitably adopted. Both the feed-screw mechanism and the ball-screw mechanism are capable of converting rotation into linear motion. In the feed-screw mechanism, a female thread part formed in an inner peripheral surface of the cylindrical rotary member and a male thread part formed in an outer peripheral surface of the movable member inserted through the rotary member are engaged (threadedly engaged) directly with each other. In the ball-screw mechanism, a spiral track is defined between the inner peripheral surface of the cylindrical rotary member and the outer peripheral surface of the movable member inserted through the rotary member. The rotary member and the movable member are engaged with each other via a number of balls which are rollably disposed within the spiral track. Typically, the rotary member may be held by the housing via a bearing. The movable member may be connected to the pin-gripping part directly or via a different member (that is, indirectly).

The handle may typically have an elongate shape and include a rod-like grip part to be held by a user. The handle that "protrudes downward from the housing" here may include not only the handle protruding in a downward direction orthogonal to the driving axis, but also the handle protruding in a generally downward direction crossing the driving axis. The trigger may be typically provided as an operation member for starting the motor.

According to one aspect of the present invention, the rotary member and the motor body may be spaced apart from each other in the front-rear direction. According to the present aspect, the motor body may not be disposed below the rotary member. Therefore, the trigger can be disposed closer to the driving axis above, so that operability of the fastening tool can be further improved.

According to one aspect of the present invention, the rotary member and the motor may be arranged to partially overlap with each other when viewed from the rear. According to the present aspect, the housing can be reduced in size in the up-down direction, and the trigger can be further reliably disposed closer to the driving axis. In a case where the rotary member has a driven gear on its outer periphery, the "rotary member" used herein may refer to an entirety of the rotary member including the driven gear.

According to one aspect of the present invention, the rotary member may have a driven gear formed on its outer periphery. The driving mechanism may include an intermediate shaft. The intermediate shaft may be configured to be rotationally driven along with rotation of the motor shaft. The intermediate shaft may have a driving gear which is engaged with the driven gear. Further, the intermediate shaft may be arranged coaxially with the motor shaft. According to the present aspect, the housing can be reduced in size in the up-down direction compared with a case in which the intermediate shaft is arranged in parallel to the motor shaft.

According to one aspect of the present invention, the driving mechanism may be configured to fasten the workpiece via the fastener and break the pin at a small-diameter part for breakage. The fastening tool may further include a pintail passage and a collection container for a pintail. The pintail passage may extend in the front-rear direction along the driving axis and be configured to allow passage of the pintail which is separated by breakage of the pin. The collection container may be removably attached to a rear end portion of the housing and have an internal space which communicates with a rear end of the pintail passage. According to the present aspect, since the pintail passage extends linearly along the driving axis, the pintail can smoothly pass the passage. Further, since the collection container can be attached to and detached from the rear end portion of the housing, attaching/detaching operation may be easier, compared with a case of the collection container to be disposed on an intermediate portion of the housing.

According to one aspect of the present invention, the collection container may be formed such that the driving axis and the rotation axis of the motor shaft are located within a region occupied by the collection container when viewed from the rear. According to the present aspect, the volume of the collection container can be secured within a reasonable range corresponding to a rear end portion of the housing.

According to one aspect of the present invention, the movable member may be configured as a hollow member having the pintail passage. The fastening tool may further include a dustproof member. The dustproof member may be held by the rear end portion of the housing and held in contact with an outer peripheral surface of a rear end portion of the movable member. The dustproof member may be disposed such that the movable member moves in the front-rear direction with the outer peripheral surface in sliding contact with the dustproof member, thereby preventing dust from entering an area forward of the dustproof member. Metal powder generated by breakage of the pin may stick to the pintail and be carried into the collection container and easily accumulated therein. This metal powder may stick to the outer peripheral surface of the rear end portion of the movable member and enter the inside of the housing. Besides metal powder, sand may also enter. According to the present aspect, the dustproof member which is arranged such that the movable member moves in the front-rear direction with the outer peripheral surface in sliding contact with the dustproof member can prevent various foreign matters (dust) such as metal powder and sand from entering an area forward of the dustproof member. Thus, a failure of the internal mechanisms due to dust can be prevented. The material of the dustproof member is not particularly limited, but, for example, felt, rubber, nonwoven fabric, paper, sponge and the like may be employed. Further, the shape of the dustproof member is not particularly limited, but, for example, an annular member which surrounds the outer peripheral surface of the movable member, a brush-like member which surrounds the outer peripheral surface of the movable member and the like may be employed.

According to one aspect of the present invention, the fastening tool may further include an illumination device and a trigger-protection part. The illumination device may be disposed in a lower end portion of the housing and configured to irradiate light to a peripheral region of a front end portion of the fastener-abutment part. The trigger-protection part may extend from the lower end portion of the housing to a front end portion of the handle, while securing a space for a user's finger in front of the trigger. The trigger-protection part may have a passage for wiring for the illumination device inside. According to the present aspect, illumination may facilitate checking the states of the fastener and the workpiece. Further, the trigger-protection part can realize both a function of preventing the trigger from being accidentally depressed and a function of providing a wiring passage for the illumination device.

According to one aspect of the present invention, the housing may include a rotary-member-holding part that supports the rotary member. The fastening tool may further include an elastic member that is disposed behind the rotary member and between the rotary member and the rotary-member-holding part. When the movable member moves the pin-gripping part rearward relative to the fastener-abutment part to pull the pin and the pin is broken, a strong force may act to relatively move the rotary member rearward on impact. Accordingly, rearward impact may be applied to a portion of the rotary-member-holding part which is disposed behind the rotary member. In the present aspect, the elastic member may be disposed between the rotary member and the rotary-member-holding part of the housing. Therefore, the possibility of damage to the rotary-member-holding part can be effectively reduced by the elastic member cushioning the impact. Thus, durability of the housing including the rotary-member-holding part can be enhanced.

According to one aspect of the present invention, the housing may include a rotary-member-holding part that supports the rotary member. The fastening tool may further include an intervening member and a position-detecting mechanism. The intervening member may be disposed between the rotary member and the rotary-member-holding part in the front-rear direction. The position-detecting mechanism may be configured to detect that the pin-gripping part is located in a specified reference position. In this case, the driving mechanism may be configured to move the pin-gripping part forward along the driving axis relative to the fastener-abutment part to be placed in a specified initial position based on a detection result of the detection device after the workpiece is fastened. Further, the intervening member may be configured to abut on an abutment part of the movable member when the pin-gripping part connected to the movable member is moved forward beyond the initial position, thereby preventing the movable member and the pin-gripping part from further moving forward. In other words, in a case where the pin-gripping part is moved forward beyond the initial position, the pin-gripping part may abut on the intervening member and may be prevented from further moving forward. It is noted that the reference position and the initial position may be the same or different. According to the present aspect, the intervening member can prevent movement of the movable member and the pin-gripping part even if the pin-gripping part is moved beyond the initial position, for example, due to malfunction of the position-detecting mechanism. Therefore, the possibility of damage to other parts can be reduced which may be caused by further forward movement of the movable member and the pin-gripping part beyond the limit.

MODES FOR CARRYING OUT THE INVENTION

An embodiment of the present invention is now described with reference to the drawings. In the following embodiment, as an example, a fastening tool 1 is described which is capable of fastening a workpiece by using a fastener.

Figure 1:
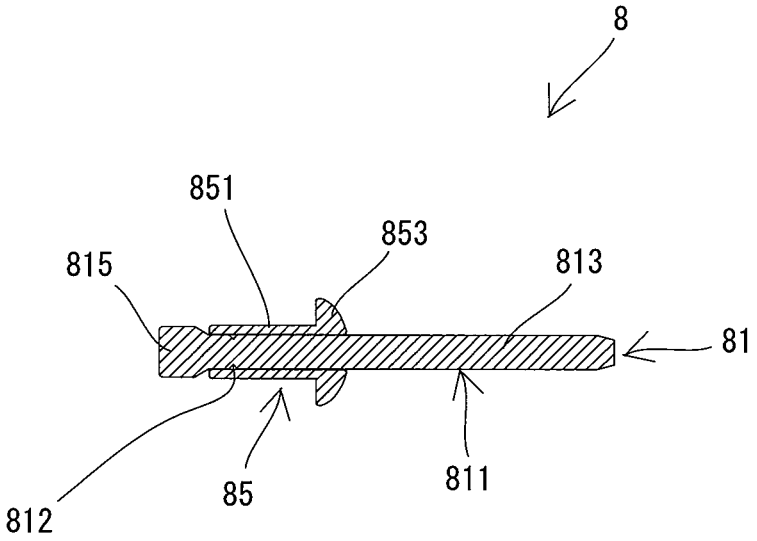
FIG. 1 illustrates a fastener (blind rivet).

First, a fastener 8 is described as an example of a fastener which can be used in the fastening tool 1, with reference to FIG. 1. The fastener 8 is a known fastener of a type which may be referred to as a blind rivet (also referred to as a blind fastener). The fastener 8 includes a pin 81 and a body 85 which are integrally formed with each other.

The body 85 is a cylindrical member which includes a cylindrical sleeve 851 and a flange 853 protruding radially outward from one end of the sleeve 851. The pin 81 is a rod-like member extending through the body 85 and protruding from both ends of the body 85. The pin 81 includes a shaft part 811 and a head 815 formed on one end portion of the shaft part 811. The head 815 has a larger diameter than the inner diameter of the sleeve 851 and is arranged to protrude from the other end of the sleeve 851 on the side opposite to the flange 853. The shaft part 811 extends through the body 85 and protrudes in an axial direction from the end of the body 85 on the side of the flange 853. A portion of the shaft part 811 which is disposed within the sleeve 851 has a small-diameter part 812 for breakage. The small-diameter part 812 has a less strength than other portions of the shaft part 811. The small-diameter part 812 is configured to be first broken when the pin 81 is pulled in the axial direction. A portion of the shaft part 811 on the side opposite to the head 815 across the small-diameter part 812 is referred to as a pintail 813. The pintail 813 is a portion to be separated from the pin 81 (the fastener 8) when the shaft part 811 is broken.

The fastening tool 1 is now described. First, the general structure of the fastening tool 1 is described with reference to FIG. 2.

Figure 2:
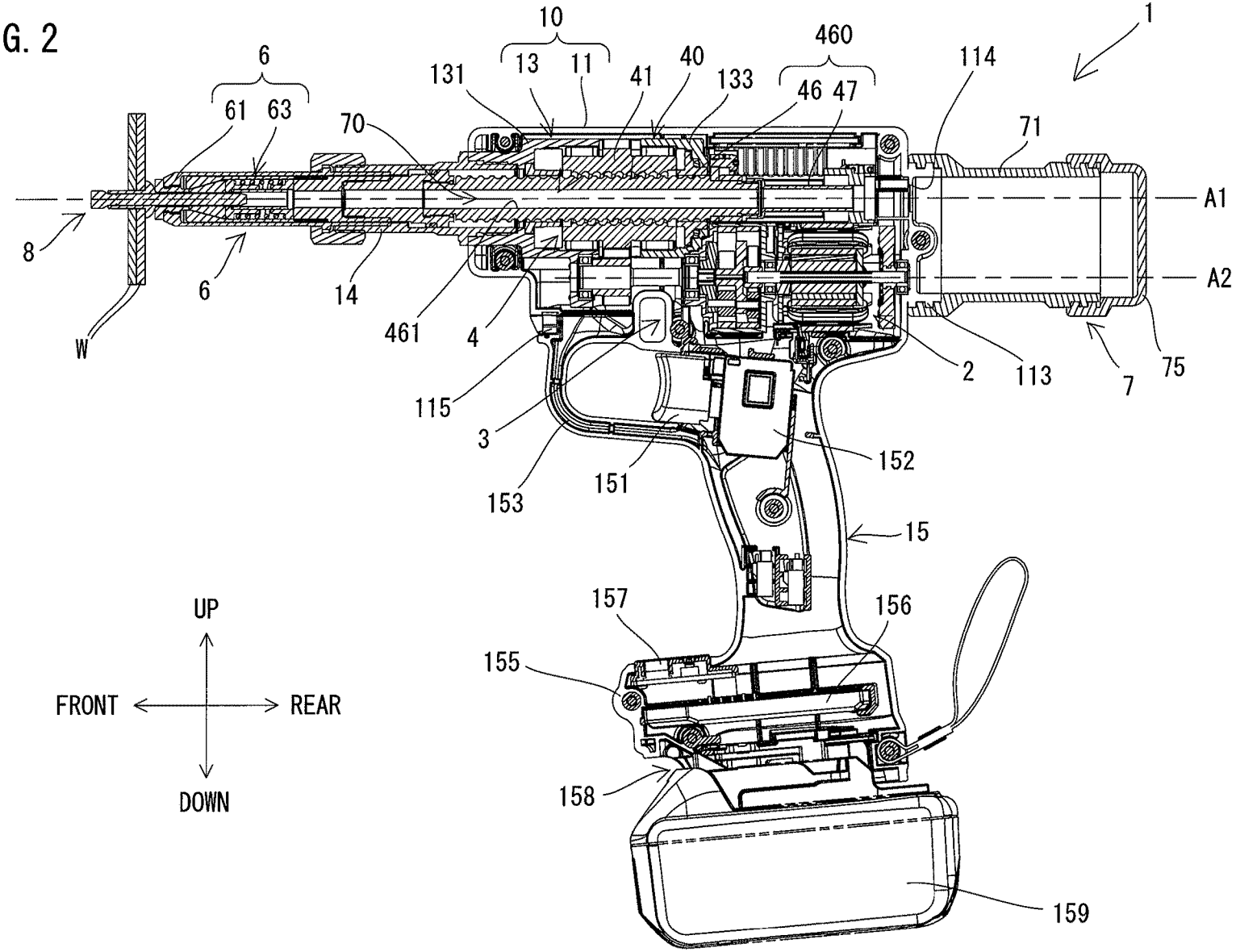
FIG. 2 is a longitudinal sectional view showing a fastening tool.

As shown in FIG. 2, an outer shell of the fastening tool 1 is mainly formed by an outer housing 11, a handle 15 and a nose part 6 which is held via a nose-holding member 14.

In the present embodiment, the outer housing 11 has a generally rectangular box-like shape and extends along a specified driving axis A1. The nose part 6 is held by one end portion of the outer housing 11 in a longitudinal direction via the nose-holding member 14 so as to extend along the driving axis A1. A collection container 7 is removably mounted to the other end portion of the outer housing 11. The collection container 7 is configured to store the pintail 813 (see FIG. 1) separated in a fastening process. The handle 15 protrudes in a direction crossing (in the present embodiment, a direction generally orthogonal to) the driving axis A1 from a central portion of the outer housing 11 in the longitudinal direction.

In the following description, for convenience of explanation, as for the direction of the fastening tool 1, an extending direction of the driving axis A1 (also referred to as a longitudinal direction of the outer housing 11) is defined as a front-rear direction of the fastening tool 1. In the front-rear direction, the side on which the nose part 6 is disposed is defined as a front side and the side on which the collection container 7 is removably mounted is defined as a rear side. Further, a direction which is orthogonal to the driving axis A1 and which corresponds to the extending direction of the handle 15 is defined as an up-down direction. In the up-down direction, the side on which the outer housing 11 is disposed is defined as an upper side and a protruding end (free end) side of the handle 15 is defined as a lower side. A direction orthogonal to the front-rear direction and the up-down direction is defined as a left-right direction.

As shown in FIG. 2, the outer housing 11 mainly houses a motor 2, a driving mechanism 4 which is configured to be driven by power of the motor 2 and a transmitting mechanism 3 which is configured to transmit power of the motor 2 to the driving mechanism 4. In the present embodiment, a portion (specifically, a nut 41 of a ball-screw mechanism 40) of the driving mechanism 4 is housed in an inner housing 13. The inner housing 13 is fixedly held by the outer housing 11. From this point of view, the outer housing 11 and the inner housing 13 can be considered as one piece in the form of a housing 10. In the present embodiment, the outer housing 11 is integrally formed of plastic with the handle 15, and the inner housing 13 is formed of metal (specifically, aluminum).

The handle 15 is configured to be held by a user. A trigger 151 is provided in an upper end portion (a base end portion connected to the outer housing 11) of the handle 15. The trigger 151 is configured to be depressed (pulled) by a user. A battery mounting part 158 is provided in a lower end portion of the handle 15. The battery mounting part 158 is configured such that a battery 159 is removably mounted thereto. The battery 159 is a rechargeable power source for supplying electric power to each part of the fastening tool 1 and the motor 2. The structures of the battery mounting part 158 and the battery 159 are well known and therefore not described here.

The fastening tool 1 of the present embodiment is configured to fasten a workpiece via the fastener 8. The fastener 8 (see FIG. 1) is gripped by a jaw 65 to be described later, in a state in which a portion of the pintail 813 is inserted into a front end portion of the nose part 6 of the fastening tool 1 and the body 85 and the head 815 protrude from a front end of the nose part 6 (see FIG. 5). Then, the sleeve 851 is inserted through mounting holes formed in workpieces W to be fastened, up to a position where the flange 853 abuts on one side of the workpieces W. When the trigger 151 is depressed, the driving mechanism 4 is driven via the motor 2. As a result, the pintail 813 gripped by a jaw assembly 63 is strongly pulled, and thus an end portion of the sleeve 851 on the head 815 side is enlarged in diameter and the workpieces W are clamped between this end portion and the flange 853. Further, the shaft part 811 is broken at the small-diameter part 812 and the pintail 813 is separated therefrom. It is noted that plural kinds of fasteners including the fastener 8 shown in FIG. 1 can be used in the fastening tool 1.

The structure of the fastening tool 1 is now described in detail.

Figure 3:
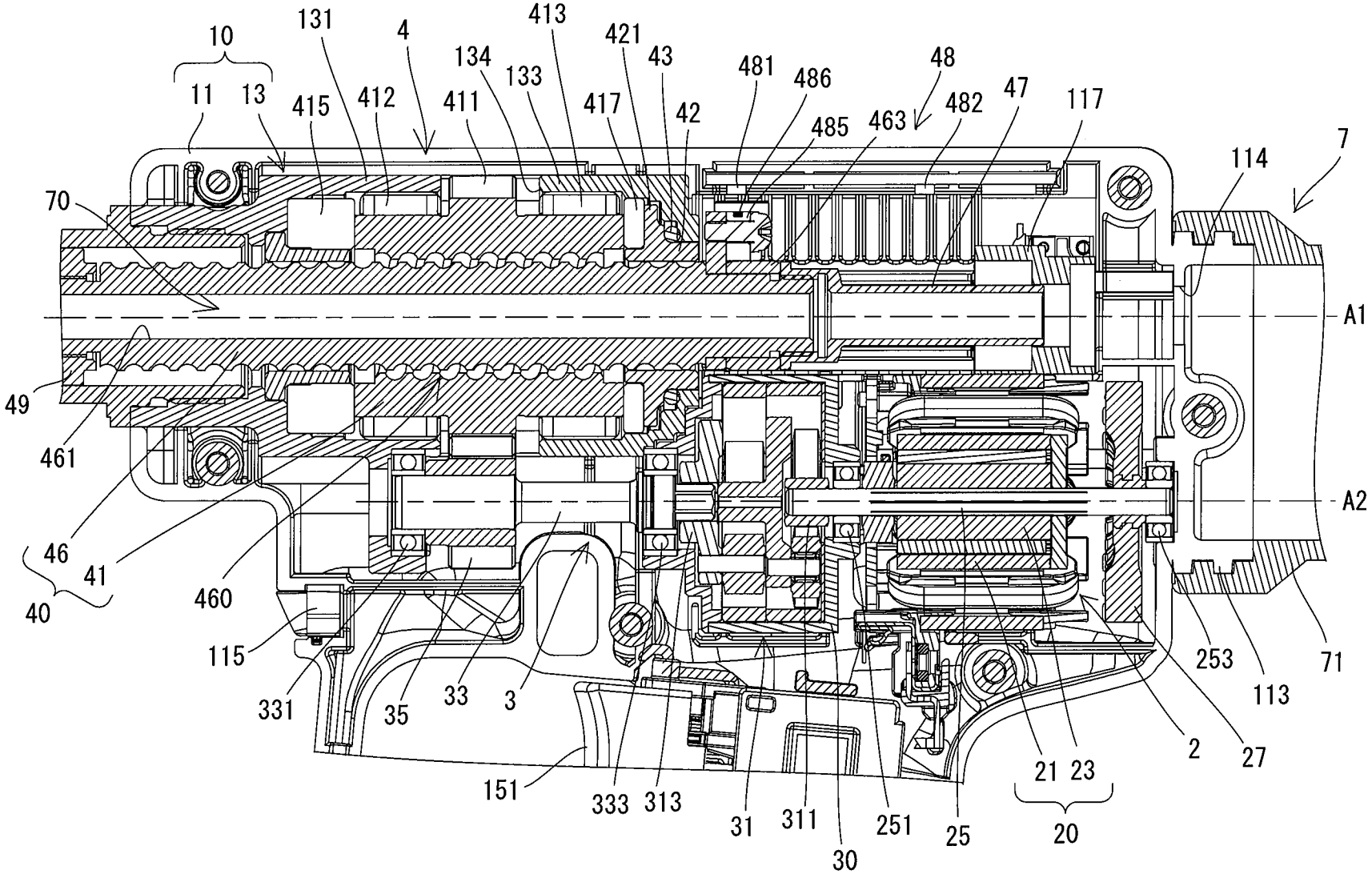
FIG. 3 is a partial, enlarged view of FIG. 2.

First, the motor 2 is described. As shown in FIG. 3, the motor 2 is housed in a lower portion of a rear end portion of the outer housing 11. In the present embodiment, a compact and high-output brushless DC motor is employed as the motor 2. The motor 2 includes a motor body 20, which includes a stator 21 and a rotor 23, and a motor shaft 25, which extends from the rotor 23 and rotates together with the rotor 23. The motor 2 is arranged such that a rotation axis A2 of the motor shaft 25 extends in parallel to the driving axis A1 (that is, in the front-rear direction) below the driving axis A1. Further, in the present embodiment, the entirety of the motor 2 is disposed below the driving axis A1. The motor shaft 25 is rotatably supported by a bearing 251 which is fixed to a rear end portion of a speed-reducer housing 30 to be described later and a bearing 253 which is fixed to a rear end portion of the outer housing 11. A front end portion of the motor shaft 25 protrudes into the speed-reducer housing 30. A fan 27 for cooling the motor 2 is fixed to a rear end portion of the motor shaft 25.

Next, the transmitting mechanism 3 is described. As shown in FIG. 3, in the present embodiment, the transmitting mechanism 3 mainly includes a planetary-gear reducer 31, an intermediate shaft 33 and a nut-driving gear 35, which are now described in this order.

The planetary-gear reducer 31 is disposed on the downstream side of the motor 2 on a power transmission path from the motor 2 to the driving mechanism 4 (specifically, a ball-screw mechanism 40). The planetary-gear reducer 31 is configured to increase torque of the motor 2 and transmit it to the intermediate shaft 33. In the present embodiment, the planetary-gear reducer 31 mainly includes two sets of planetary-gear mechanisms and the speed-reducer housing 30 which houses the planetary-gear mechanisms. It is noted that the speed-reducer housing 30 is formed of plastic and fixedly held by the outer housing 11 in front of the motor 2. The structure of the planetary-gear mechanism itself is well known and therefore not described in further detail here. The motor shaft 25 is an input shaft for inputting rotating power into the planetary-gear reducer 31. A sun gear 311 of a first (upstream) planetary-gear mechanism of the planetary-gear reducer 31 is fixed to a front end portion (the portion which protrudes into the speed-reducer housing 30) of the motor shaft 25. A carrier 313 of a second (downstream) planetary-gear mechanism is a final output shaft of the planetary-gear reducer 31.

The intermediate shaft 33 is configured to rotate together with the carrier 313. Specifically, the intermediate shaft 33 is arranged coaxially with the motor shaft 25 and its rear end portion is connected to the carrier 313. Front and rear end portions of the intermediate shaft 33 are rotatably supported by a bearing 331 which is fixed to a lower front end portion of the inner housing 13 and a bearing 333 which is fixed to a front end portion of the speed-reducer housing 30, respectively.

The nut-driving gear 35 is fixed onto an outer periphery of a front end portion of the intermediate shaft 33. The nut-driving gear 35 is engaged with a driven gear 411 formed on an outer periphery of the nut 41, which will be described later, and transmits the rotating power of the intermediate shaft 33 to the nut 41. The nut-driving gear 35 and the driven gear 411 are configured as a speed-reducing-gear mechanism. Further, in the present embodiment, the reduction ratio of the transmitting mechanism 3 as a whole is set to 3 or less.

The driving mechanism 4 is now described.

As shown in FIG. 3, in the present embodiment, the driving mechanism 4 mainly includes the ball-screw mechanism 40 which is housed in an upper portion of the outer housing 11. The structures of the ball-screw mechanism 40 and its peripheries are now described.

The ball-screw mechanism 40 is described below.

Figure 4:
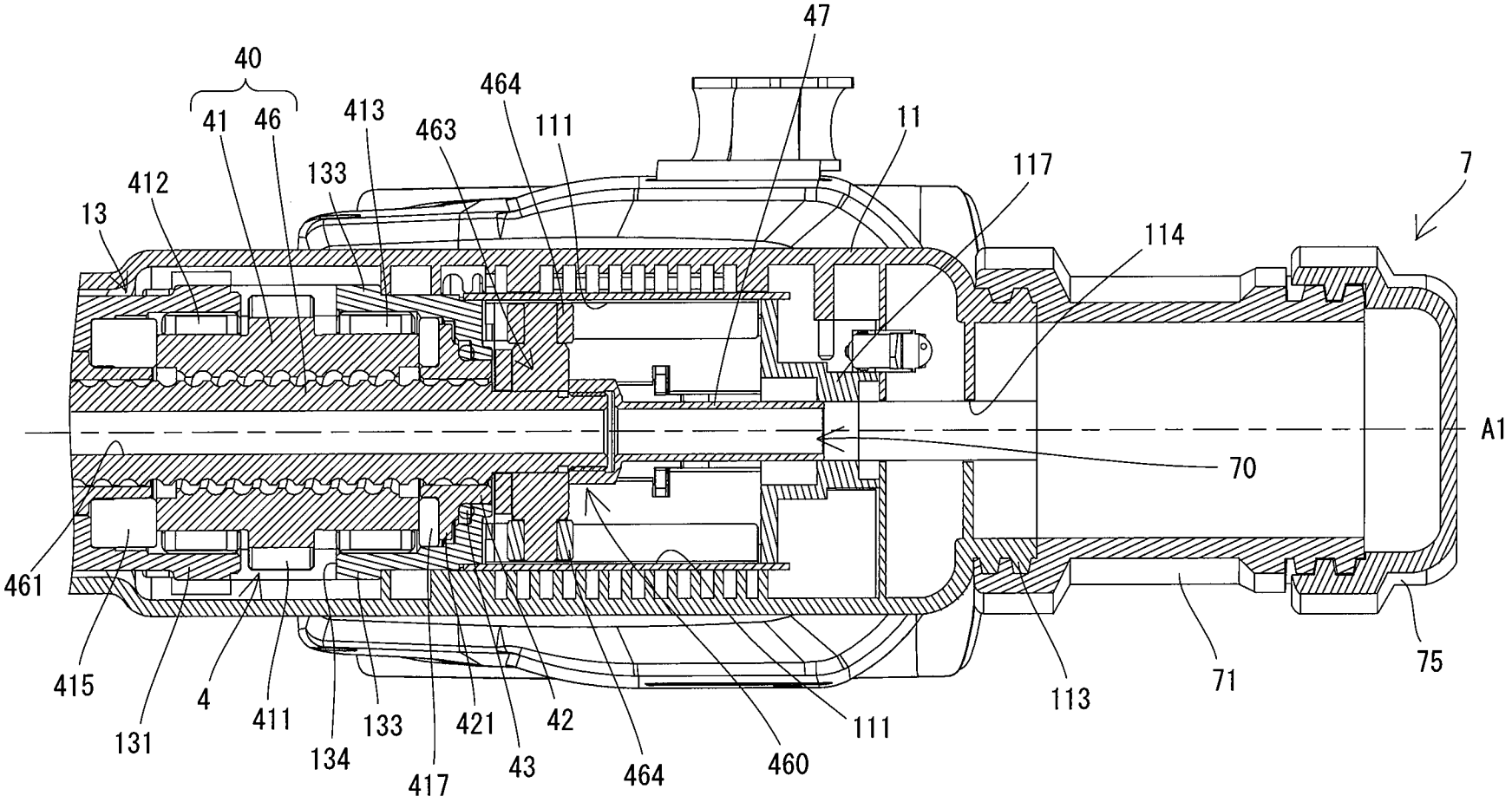
FIG. 4 is a cross-sectional view of a rear portion of the fastening tool.

As shown in FIGS. 3 and 4, the ball-screw mechanism 40 mainly includes the nut 41 and a screw shaft 46. In the present embodiment, the ball-screw mechanism 40 is configured to convert rotation of the nut 41 into linear motion of the screw shaft 46 and to linearly move the jaw assembly 63, which will be described later (see FIG. 5).

The nut 41 is supported by the inner housing 13 so as to be rotatable around the driving axis A1 while its movement in the front-rear direction is restricted. The nut 41 is cylindrically shaped and has the driven gear 411 integrally formed on its outer periphery. A pair of radial bearings 412, 413 are fitted onto the nut 41 on the front and rear sides of the driven gear 411. The nut 41 is supported via the radial bearings 412, 413 so as to be rotatable around the driving axis A1 relative to the inner housing 13.

In the present embodiment, the inner housing 13 includes a front housing 131 and a rear housing 133. The front housing 131 holds a front portion (specifically, a portion extending forward from the driven gear 411) of the nut 41. The rear housing 133 holds a rear portion (specifically, the driven gear 411 and a portion extending rearward from the driven gear 411) of the nut 41. The front housing 131 is configured to cover a region in front of the nut 41 and an outer periphery of the front portion of the nut 41. The rear housing 133 is configured to cover a region behind the nut 41 and an outer peripheries of the driven gear 411 and the rear portion of the nut 41. With such a structure of the inner housing 13 having the two parts disposed on the front and rear sides of the nut 41, movement of the nut 41 in the front-rear direction can be more reliably restricted during operation of the driving mechanism 4. It is noted that the front housing 131 and the rear housing 133 are connected and fixed in the front-rear direction by screws (not shown) to be integrated as one unit. The radial bearings 412, 413 are fixed to the insides of the front housing 131 and the rear housing 133, respectively.

The portions of the front housing 131 and the rear housing 133 which cover the outer periphery of the nut 41 have a rectangular external shape as a whole. An opening 134 is formed in a portion corresponding to the driven gear 411 in each of four upper, lower, left and right sides of the rear housing 133. The diameter of the driven gear 411 is set such that the outer periphery of the driven gear 411 is placed substantially flush with the outer surface of the inner housing 13 through the opening 134 formed in the upper side of the rear housing 133. Thus, the outer periphery of the driven gear 411 does not protrude upward from the upper surface of the inner housing 13. In this manner, reduction of a so-called center height (the distance from the driving axis A1 to the upper surface of the outer housing 11) of fastening tool 1 is realized. The driven gear 411 engages with the nut-driving gear 35. The driven gear 411 is rotated by the nut-driving gear 35, which causes the nut 41 to rotate around the driving axis A1.

The screw shaft 46 is engaged with the nut 41 so as to be movable along the driving axis A1 in the front-rear direction while its rotation around the driving axis A1 is restricted. Specifically, as shown in FIGS. 3 and 4, the screw shaft 46 is formed as an elongate member. The screw shaft 46 is inserted through the nut 41 and extends along the driving axis A1. A spiral track is defined by a spiral groove formed in an inner peripheral surface of the nut 41 and a spiral groove formed in an outer peripheral surface of the screw shaft 46. A number of balls (not shown) are rollably disposed within the spiral track. The screw shaft 46 is engaged with the nut 41 via these balls. Thus, the screw shaft 46 linearly moves along the driving axis A1 in the front-rear direction when the nut 41 is rotationally driven.

As shown in FIG. 4, a central portion of a roller holding part 463 is fixed to a rear end portion of the screw shaft 46. The roller holding part 463 has arms protruding orthogonally to the screw shaft 46 leftward and rightward from the central portion. Rollers 464 are rotatably held on right and left end portions of the arms, respectively. Roller guides 111 extending in the front-rear direction are fixed to right and left inner walls of the outer housing 11, respectively, corresponding to the pair of right and left rollers 464. Although not shown in detail, each of the rollers 464 is restricted from moving upward and downward by the roller guide 111. Therefore, the roller 464 disposed within the roller guide 111 can roll along the roller guide 111 in the front-rear direction.

In the ball-screw mechanism 40 having the above-described structure, when the nut 41 is rotated around the driving axis A1, the screw shaft 46 engaged with the nut 41 via the balls linearly moves in the front-rear direction relative to the nut 41 and the housing 10. When the nut 41 is rotated, the screw shaft 46 may be subjected to torque around the driving axis A1. By abutment of the roller 464 with the roller guide 111, however, rotation of the screw shaft 46 around the driving axis A1 due to such torque can be restricted.

The peripheral structure of the nut 41 within the inner housing 13 is now described.

As shown in FIGS. 3 and 4, in the front-rear direction, a thrust bearing 415 is disposed between the front end of the nut 41 and the front housing 131, while a thrust bearing 417, an intervening member 42 and an elastic member 43 are disposed between the rear end of the nut 41 and the rear housing 133. These members are now described in order.

The thrust bearing 415 is configured to receive a forward load which is applied to the nut 41 when the pin 81 of the fastener 8 is strongly pulled rearward relative to the body 85, while allowing the nut 41 to rotate.

The fastening tool 1 of the present embodiment is configured to be used with a multi-piece swage type fastener, as well as with the fastener 8 referred to as a blind rivet, by replacing the nose part 6, which will be described in detail later. Like the fastener 8, the multi-piece swage type fasteners include a fastener of a type in which a pintail is to be torn off (hereinafter referred to as a tear-off type fastener) and a fastener of a type in which a shaft part is retained as it is (hereinafter referred to as a shaft-retaining type fastener). When the shaft-retaining type fastener is used, the screw shaft 46 is first moved rearward until an appropriate swaging force is applied to a collar of the fastener. Thereafter, the screw shaft 46 is moved forward with the pin being gripped by the jaw assembly 63 (see FIG. 5). In this process, the collar swaged firmly to a tapered hole within the nose part is separated forward, so that a rearward load is applied to the nut 41. Therefore, the thrust bearing 417 is provided to receive this rearward load while allowing the nut 41 to rotate.

The intervening member 42 is disposed between the nut 41 and a rear end portion of the rear housing 133 in the front-rear direction. In the present embodiment, the intervening member 42 is formed as a cylindrical member having a flange 421 on its central portion. The intervening member 42 is disposed within the rear housing 133 with the screw shaft 46 being coaxially inserted therethrough.

The elastic member 43 is disposed between the flange 421 and the rear end portion of the rear housing 133 in the front-rear direction. The elastic member 43 can cushion an impact on the rear housing 133, in a case where a strong force acts to relatively move the nut 41 rearward on impact when the pin 81 of the fastener 8 is strongly pulled rearward relative to the body 85 and the pintail 813 is torn off. In the present embodiment, a rubber O-ring is employed as the elastic member 43.

Further, the elastic member 43 is disposed between the flange 421 and the rear end portion of the rear housing 133 in a pressurized state (in a slightly compressed state). Thus, the intervening member 42 is normally held in a position in which a front surface of the flange 421 abuts on the thrust bearing 417 while a rear surface of the flange 421 is slightly separated forward from a front surface of the rear end portion of the rear housing 133. The distance between the rear surface of the flange 421 and the front surface of the rear end portion of the rear housing 133 at this time defines an upper limit of a distance (in other words, an amount of compression of the elastic member 43) by which the intervening member 42 and the nut 41 are allowed to move rearward relative to the rear housing 133.

Further, a cylindrical rear end portion of the intervening member 42 is slidably arranged within a through hole which is formed in the rear end portion of the rear housing 133. Normally, a rear end surface of the intervening member 42 is located generally in the same position as a rear end surface of the rear housing 133 in the front-rear direction (in other words, the rear end surface of the intervening member 42 is flush with the rear end surface of the rear housing 133). In the present embodiment, the inner housing 13 is formed of aluminum, while the intervening member 42 is formed of iron. The rear end portion of the intervening member 42 functions as a movement-restricting part (stopper) in a case where the screw shaft 46 and the jaw assembly 63 are moved forward beyond an initial position, which will be described in detail later.

The peripheral structure of the rear end portion of the screw shaft 46 and the internal structure of the rear end portion of the outer housing 11 in which the rear end portion of the screw shaft 46 is disposed are now described.

As shown in FIG. 3, a magnet-holding part 485 is fixed to the roller holding part 463, which is fixed to the rear end portion of the screw shaft 46. The magnet-holding part 485 is disposed on an upper side of the screw shaft 46. A magnet 486 is mounted on an upper end of the magnet-holding part 485. The magnet 486 is fixed to be part of the screw shaft 46, so that the magnet 486 moves in the front-rear direction along with movement of the screw shaft 46 in the front-rear direction.

A position-detecting mechanism 48 is provided in the outer housing 11. The position-detecting mechanism 48 is configured to detect the position of the screw shaft 46 (in other words, the position of the jaw assembly 63) relative to the housing 10 in the front-rear direction via the magnet 486. In the present embodiment, the position-detecting mechanism 48 includes an initial-position sensor 481 and a stop-position sensor 482. The initial-position sensor 481 and the stop-position sensor 482 are both electrically connected to a controller 156 (see FIG. 2) via wiring (not shown). The initial-position sensor 481 and the stop-position sensor 482 are configured to output their respective specified signals to the controller 156 when the magnet 486 is located within their respective specified detection ranges. The initial-position sensor 481 is mounted in such a position as to detect the magnet 486 when the screw shaft 46 is placed in an initial position. The stop-position sensor 482 is mounted in such a position as to detect the magnet 486 when the screw shaft 46 is placed in a stop position. In the present embodiment, the initial position is set in the vicinity of a frontmost position within a physically movable range of the screw shaft 46. The stop position is set at a rearmost position within the movable range of the screw shaft 46.

As shown in FIGS. 3 and 4, an extension shaft 47 is coaxially connected and fixed to the rear end portion of the screw shaft 46 and integrated with the screw shaft 46. The screw shaft 46 and the extension shaft 47 which are integrated with each other are hereinafter also collectively referred to as a driving shaft 460. The driving shaft 460 has a through hole 461 extending therethrough along the driving axis A1. The diameter of the through hole 461 is set to be slightly larger than the largest possible diameter of a pintail of a fastener which can be used in the fastening tool 1.

An opening 114 is formed on the driving axis A1 in the rear end portion of the outer housing 11. The opening 114 allows communication between the inside and the outside of the outer housing 11. A cylindrical guide sleeve 117 is fixed in front of the opening 114. The guide sleeve 117 has an inner diameter which is substantially equal to the outer diameter of the extension shaft 47. A rear end of the extension shaft 47 (the driving shaft 460) is located within the guide sleeve 117 when the screw shaft 46 (the driving shaft 460) is placed in the initial position (the position shown in FIGS. 3 and 4). When the screw shaft 46 (the driving shaft 460) is moved rearward from the initial position along with rotation of the nut 41, the extension shaft 47 moves rearward while sliding within the guide sleeve 117.

As shown in FIGS. 3 and 4, a container-connection part 113 is formed on the rear end portion of the outer housing 11. The container-connection part 113 has a cylindrical shape and protrudes rearward. The container-connection part 113 is configured such that the collection container 7 for the pintail 813 is removably attached thereto. As shown in FIGS. 2 and 4, the collection container 7 includes a cylindrical member 71 and a lid member 75 which has a bottomed cylindrical shape and is configured to be removably mounted to the cylindrical member 71. A female thread is formed on an inner periphery of an opening-side end portion of the cylindrical member 71, while a male thread is formed on an outer periphery of the container-connection part 113. A user can threadedly engage the cylindrical member 71 with the container-connection part 113 in order to attach the collection container 7 to the outer housing 11 such that the opening 114 communicates with the internal space of the collection container 7. It is noted that a male thread is formed, corresponding to the male thread of the container-connection part 113, on an outer periphery of a rear end portion of the cylindrical member 71. A female thread is formed on an inner periphery of an opening-side end portion of the lid member 75 to be threadedly engaged with this male thread. Thus, the lid member 75 is configured to be threadedly engageable not only with the cylindrical member 71 but also with the container-connection part 113.

The structures of the nose part 6 and the nose-holding member 14 are now described.

First, the nose part 6 is described.

Figure 5:
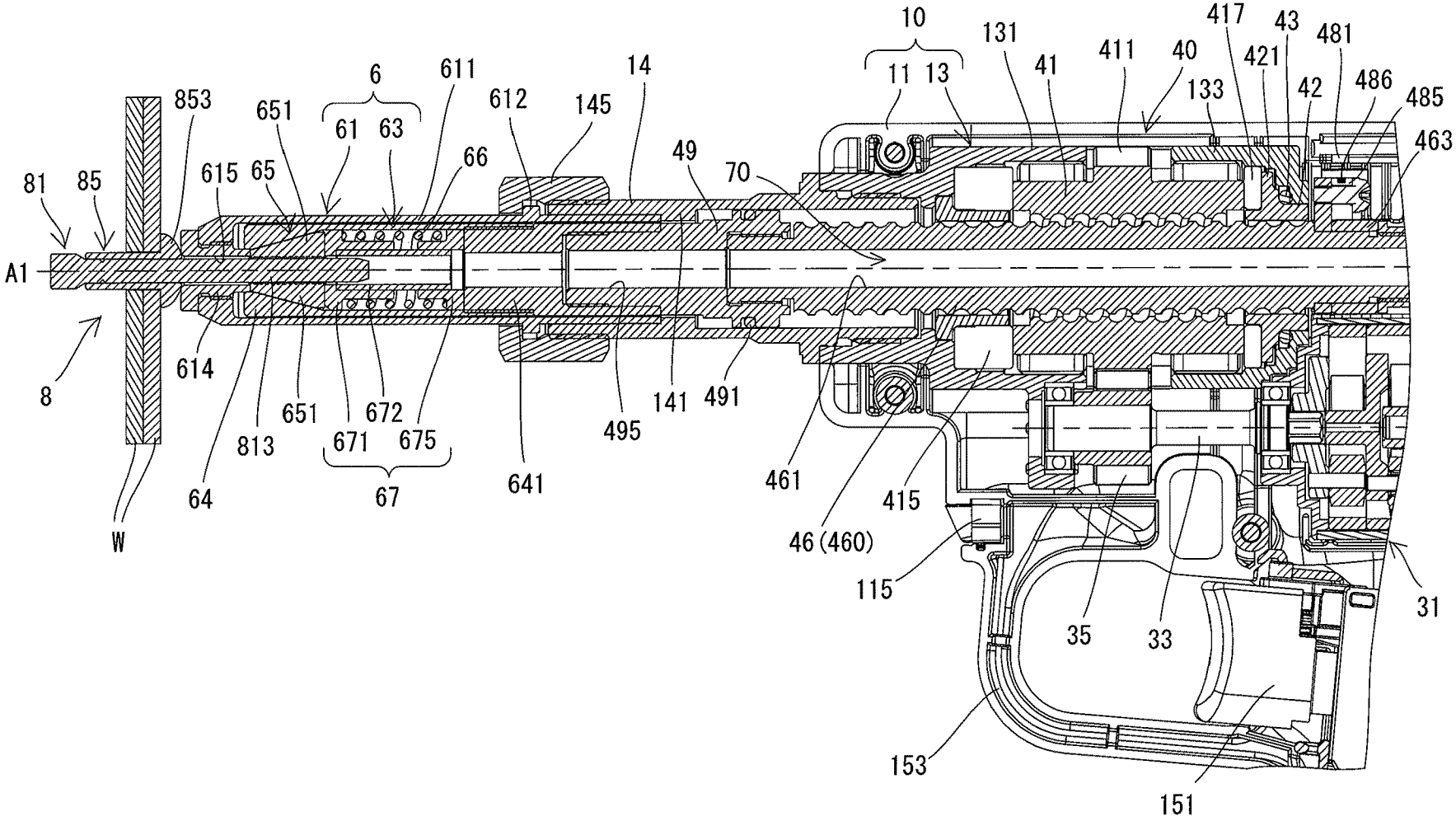
FIG. 5 is another partial, enlarged view of FIG. 2.

As shown in FIG. 5, the nose part 6 mainly includes an anvil 61 and the jaw assembly 63. The anvil 61 is configured to abut on the body 85 (the flange 853) of the fastener 8. The jaw assembly 63 is configured to grip the pin 81 (the pintail 813) of the fastener 8. Further, the jaw assembly 63 is held to be movable along the driving axis A1 relative to the anvil 61.

In the present embodiment, the nose part 6 is configured to be removably attached to a front end portion of the housing 10 via the nose-holding member 14. As described above, the fastening tool 1 of the present embodiment is configured to be used with the fastener 8 referred to as a blind rivet as well as with a multi-piece swage type fastener. A user may attach to the housing 10 an appropriate kind of nose part according to the fastener to be actually used. In the present embodiment, the nose part 6 for the fastener 8 is described as an example, but it can be said that a nose part for a multi-piece swage type fastener basically has the same structure as the nose part 6. Specifically, the nose part for the multi-piece swage type fastener also has an anvil configured to abut on a cylindrical part (collar) of the fastener, and a jaw assembly configured to grip a pin and held to be movable along the driving axis A1 relative to a fastener-abutment part. In the following description, a direction of the nose part 6 is described on the basis of the state of the nose part 6 attached to the housing 10.

The anvil 61 is now described.

As shown in FIG. 5, in the present embodiment, the anvil 61 includes an elongate cylindrical sleeve 611 and a nose tip 614 fixed to a front end portion of the sleeve 611. The inner diameter of the sleeve 611 is set to be substantially equal to the outer diameter of a jaw case 64 of the jaw assembly 63, which will be described later. The sleeve 611 has locking ribs 612 formed at a region slightly toward a rear end from a central portion of an outer periphery of the sleeve 611. The locking ribs 612 protrude radially outward. The nose tip 614 is configured such that its front end portion can abut on the flange 853 of the fastener 8. Further, the nose tip 614 is disposed such that its rear end portion protrudes into the sleeve 611. The nose tip 614 has an insertion hole 615 through which the pintail 813 can be inserted.

The jaw assembly 63 is now described. As shown in FIG. 5, in the present embodiment, the jaw assembly 63 mainly includes the jaw case 64, a connecting member 641, a jaw 65 and a biasing spring 66, which are now described in this order.

The jaw case 64 is configured to be slidable within the sleeve 611 of the anvil 61 along the driving axis A1. Further, the jaw case 64 is cylindrically shaped to hold the jaw 65 inside. It is noted that the jaw case 64 has a substantially uniform inner diameter, except that only its front end portion is configured as a tapered part reducing in inner diameter toward the front. In other words, an inner peripheral surface of the front end portion of the jaw case 64 is configured as a conical tapered surface reducing in diameter toward its front end. Further, a front end portion of the cylindrical connecting member 641 is threadedly engaged with a rear end portion of the jaw case 64 and integrated with the jaw case 64. A rear end portion of the connecting member 641 is configured to be threadedly engaged with a front end portion of a connecting member 49 described later.

The jaw 65 as a whole has a conical cylindrical shape, corresponding to the tapered surface of the jaw case 64. The jaw 65 is disposed coaxially with the jaw case 64 within a front end portion of the jaw case 64. The jaw 65 has a plurality of (for example, three) claws 651. The claws 651 are configured to grip a portion of the pintail 813 and arranged around the driving axis A1. An inner peripheral surface of the claw 651 has irregularities so as to improve ease of gripping the pintail 813.

The biasing spring 66 is disposed between the jaw 65 and the connecting member 641 in the front-rear direction. The jaw 65 is biased forward by a biasing force of the biasing spring 66 and its outer peripheral surface is held in abutment with the tapered surface of the jaw case 64. In the present embodiment, the biasing spring 66 is held by spring-holding members 67 disposed between the jaw 65 and the connecting member 641.

The spring-holding members 67 include a cylindrical first member 671 and a cylindrical second member 675. The first member 671 and the second member 675 are disposed to be slidable along the driving axis A1 within the jaw case 64. The first member 671 is disposed on the front side of the biasing spring 66 and abuts on the jaw 65, and the second member 675 is disposed on the rear side of the biasing spring 66 and abuts on the connecting member 641. The first member 671 and the second member 675 each have an outer diameter smaller than the inner diameter of the jaw case 64. Flanges are respectively provided on a front end portion of the first member 671 and a rear end portion of the second member 675, and protrude radially outward. The outer diameters of the flanges are generally equal to the inner diameter of the jaw case 64 (except for the tapered part). The biasing spring 66 is mounted on the first member 671 and the second member 675 with its front and rear ends being in abutment with the flanges of the first member 671 and the second member 675, respectively. It is noted that a cylindrical sliding part 672 is fixed in the inside of the first member 671 and protrudes rearward. A rear end portion of the sliding part 672 is slidably inserted into the second member 675. The inner diameter of the sliding part 672 is substantially equal to the diameter of the through hole 461 of the screw shaft 46.

With the above-described structure, when the jaw case 64 moves in the direction of the driving axis A1 relative to the anvil 61, the arrangement relation between the jaw case 64 and the jaw 65 in the direction of the driving axis A1 is changed, due to the biasing force of the biasing spring 66. At this time, each of the claws 651 of the jaw 65 moves in both the direction of the driving axis A1 and a radial direction, while a tapered surface of an outer periphery of the claw 651 slides on the tapered surface of the jaw case 64, so that the adjacent claws 651 move toward or away from each other. As a result, the gripping force of the jaw 65 gripping the pintail 813 is changed.

Specifically, when the screw shaft 46 and the jaw assembly 63 are located in the initial position as shown in FIG. 5, the jaw 65 is held with the tapered surfaces of the outer peripheries of the claws 651 being in abutment with the tapered surface of the jaw case 64 and in abutment with a rear end of the above-described nose tip 614 protruding into the front end portion of the jaw case 64. In the present embodiment, the initial position of the screw shaft 46 and the jaw assembly 63 is adjusted such that the claws 651 can loosely grip the pintail 813 inserted into the jaw 65 with a gripping force which is strong enough to prevent the fastener 8 from slipping out of the nose part 6 by its own weight.

When the jaw assembly 63 moves rearward along the driving axis A1 relative to the anvil 61, the jaw case 64 moves rearward relative to the jaw 65 biased forward by the biasing spring 66. The claws 651 move toward each other by interaction between the tapered surfaces of the claws 651 and the tapered surface of the jaw case 64. As a result, the pintail 813 is firmly gripped by the jaw 65. On the other hand, when the jaw assembly 63 moves to the initial position along the driving axis A1, the jaw 65 abuts on the rear end of the nose tip 614 and the jaw case 64 moves forward relative to the jaw 65. Then the claws 651 move away from each other. As a result, gripping of the pintail 813 by the jaw 65 can be released. Thus, the pintail 813 can be released from the jaw 65. A fastening process of the fastening tool 1 will be described in detail later.

The nose-holding member 14 is now described.

As shown in FIG. 5, the nose-holding member 14 is cylindrically formed. The nose-holding member 14 is fixed to a front end portion of the housing 10 and protrudes forward along the driving axis A1. More specifically, the nose-holding member 14 is threadedly engaged with a cylindrical front end portion of the inner housing 13 (the front housing 131) and thereby integrally connected to the housing 10. The inner diameter of a rear portion of the nose-holding member 14 is set to be larger than the outer diameter of the screw shaft 46. Further, the nose-holding member 14 has an annular locking part 141 protruding radially inward in its central portion in the front-rear direction. The inner diameter of the portion of the nose-holding member 14 which forms the locking part 141 is set to be substantially equal to the outer diameter of the jaw assembly 63. The inner diameter of a portion of the nose-holding member 14 which extends forward from the locking part 141 is set to be substantially equal to the outer diameter of the anvil 61.

The connecting member 49 is connected to a front end portion of the screw shaft 46. The connecting member 49 is a member for connecting the screw shaft 46 and the jaw assembly 63. The connecting member 49 is cylindrically formed and integrally connected to the screw shaft 46 with its rear end portion being threadedly engaged with the front end portion of the screw shaft 46. The outer diameter of a rear end portion of the connecting member 49 is set to be substantially equal to the inner diameter of the nose-holding member 14. An O-ring 491 for preventing leakage of grease is fitted in an annular groove which is formed in an outer periphery of the rear end portion of the connecting member 49. The connecting member 49 slides within the nose-holding member 14 along with movement of the screw shaft 46 in the front-rear direction. A front end portion of the connecting member 49 is threadedly engaged with a rear end portion of the jaw assembly 63 (specifically, the connecting member 641). Thus, the jaw assembly 63 is integrally connected to the screw shaft 46 via the connecting member 49. A through hole 495 extending through both of the connecting members 49, 641 along the driving axis A1 is defined by the connecting member 49 being connected to the connecting member 641. The diameter of the through hole 495 is generally equal to that of the through hole 461 of the screw shaft 46.

The nose part 6 is connected to the housing 10 as follows. After the jaw assembly 63 is connected to the connecting member 49 as described above, a rear end portion of the anvil 61 (specifically, the sleeve 611) is inserted into the nose-holding member 14. Further, a cylindrical fixing ring 145 is threadedly engaged with an outer periphery of the front end portion of the nose-holding member 14, so that the nose part 6 is connected to the housing 10 via the nose-holding member 14. The anvil 61 is positioned such that its rear end abuts on the locking part 141 of the nose-holding member 14 and the locking ribs 612 are disposed between a front end portion of the fixing ring 145 and a front end of the nose-holding member 14.

When the nose part 6 is connected to the housing 10 via the nose-holding member 14, as shown in FIG. 2, a passage 70 is defined which extends from a front end of the nose part 6 to the opening 114 of the outer housing 11 along the driving axis A1. More specifically, the passage 70 is defined by the insertion hole 615 of the nose tip 614, the inside of the jaw 65, the inside of the spring-holding member 67, the through hole 495 (see FIG. 5) of the connecting members 641, 49, the through hole 461 of the driving shaft 460 and the opening 114 (see FIG. 3). The pintail 813 of the fastener 8 is passed through the passage 70 and stored in the collection container 7, which will be described in detail later. The distance from a rear end of the guide sleeve 117, in which a rear end portion of the driving shaft 460 is disposed, to an opening end of the opening 114 is set to be shorter than the length of the pintail 813. Thus, the pintail 813 can be prevented from deviating from the passage 70 and entering the outer housing 11 when the pintail 813 is discharged from the through hole 461 while the driving shaft 460 is located in the initial position.

The handle 15 and its peripheral structure are now described.

As shown in FIG. 2, the trigger 151 is provided on the front side of an upper end portion of the handle 15. A switch 152 is housed within the handle 15 behind the trigger 151. The switch 152 may be switched on and off according to depressing operation of the trigger 151. Further, a trigger guard 153 is provided to prevent erroneous operation of the trigger 151 which may be caused if something abuts and presses the trigger 151. In the present embodiment, the trigger guard 153 is configured to extend from a front lower end portion of the outer housing 11 to a front end portion of the handle 15 (specifically, a lower side of the trigger 151), while securing a space for a user's finger in front of the trigger 151.

In the present embodiment, an illumination unit 115 is provided in the front lower end portion of the outer housing 11. The illumination unit 115 mainly includes an light emitting diode (LED) as a light source and a case which is formed of a light-transmitting material (such as transparent plastic, glass and the like) and houses the LED. In the illumination unit 115, an irradiation direction of light is set such that light emitted by the LED illuminates a peripheral region of a front end portion of the fastener-abutment part (in other words, a position to be fastened by the fastener 8). The illumination unit 115 is electrically connected to the controller 156 via wiring (not shown). The trigger guard 153 has a passage for this wiring inside. Thus, the trigger guard 153 has both a function of preventing erroneous operation of the trigger 151 and a function as a wiring passage.

A lower end portion of the handle 15 has a rectangular box-like shape and forms a controller housing part 155. The controller 156 for controlling operations of the fastening tool 1 is housed in the controller housing part 155. In the present embodiment, a control circuit formed by a microcomputer including a CPU, a ROM and a RAM is adopted as the controller 156. The controller 156 is connected to the switch 152, the illumination unit 115 and the position-detecting mechanism 48 via wiring (not shown).

The battery mounting part 158 is provided in a lower end portion of the controller housing part 155. Further, an operation part 157, which is configured to be externally operated by a user, is provided on a top of the controller housing part 155. In the present embodiment, as described above, the fastening tool 1 is configured to be used with tear-off type fasteners, including the fastener 8, and shaft-retaining type fasteners, and the controller 156 controls driving of the motor 2 according to the operation mode corresponding to the type of the fastener to be used. For this purpose, the operation part 157 is provided with buttons for setting the operation mode and control conditions according to user's external operation.

The arrangement relation among specific mechanisms in the fastening tool 1 having the above-described structure is now described.

First, the arrangement relation among the driving mechanism 4 (the ball-screw mechanism 40), the motor 2 and the handle 15 is as follows.

As shown in FIG. 3, in regard to the up-down direction, the rotation axis A2 of the motor shaft 25 extends in parallel to the driving axis A1 on the lower side of the driving axis A1. In other words, the motor 2 is not arranged coaxially with the driving mechanism 4. Therefore, compared with a structure in which the motor 2 is arranged coaxially with the driving mechanism 4, the housing 10 can be reduced in size in the front-rear direction. Particularly, in the present embodiment, since the entirety of the motor 2 is arranged below the screw shaft 46 which moves along the driving axis A1, reliable size reduction can be realized in the front-rear direction.

Figure 6:
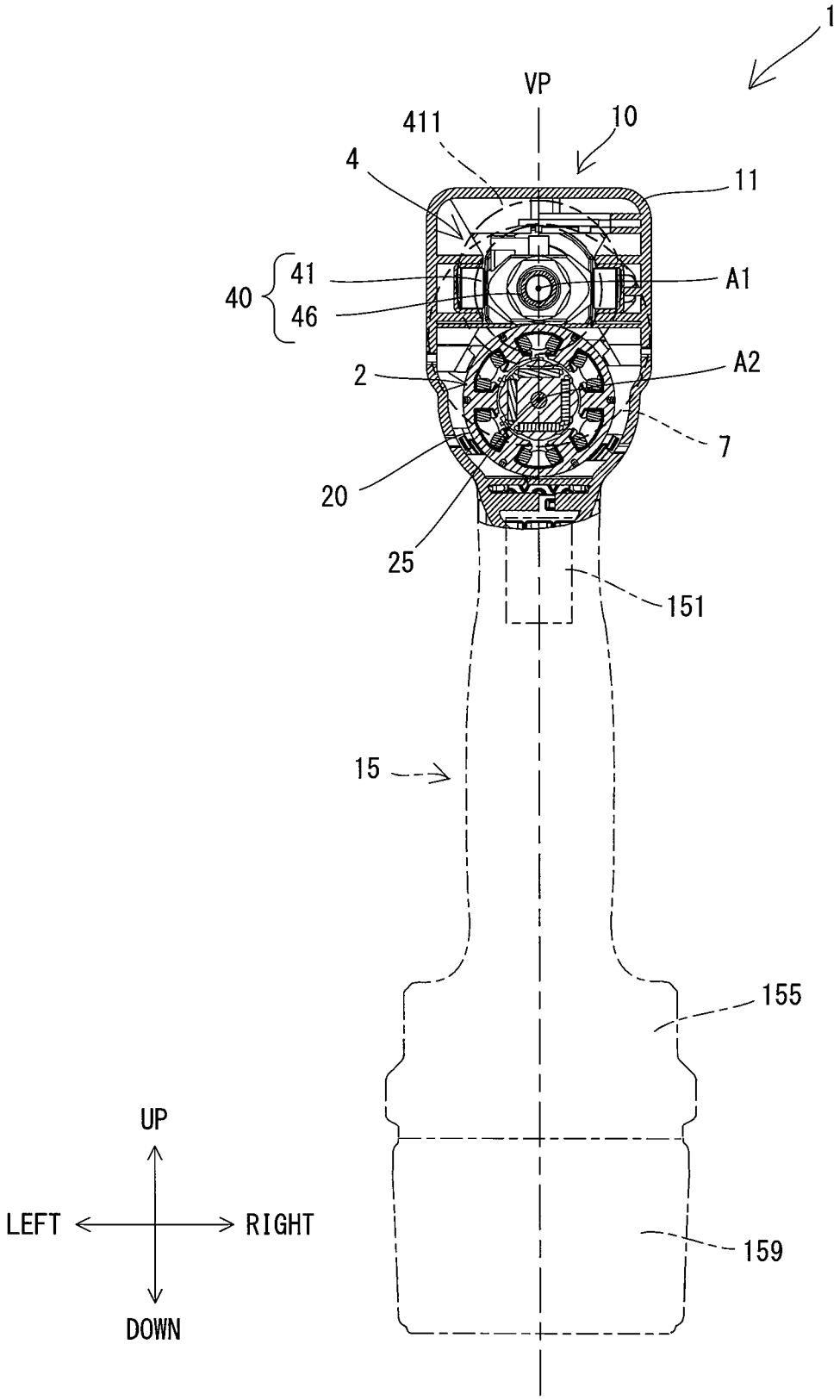
FIG. 6 is an explanatory drawing for illustrating the arrangement of a driving mechanism, a motor, a handle and a collection container as viewed from the rear of the fastening tool.

Further, as shown in FIG. 6, a virtual plane VP which includes the driving axis A1 and the rotation axis A2 of the motor shaft 25 passes the center of the handle 15 in the left-right direction. In other words, the ball-screw mechanism 40 including the nut 41 and the screw shaft 46, the motor 2 and the handle 15 are arranged to have left-right symmetry (arranged in plane symmetry relative to the virtual plane VP). Thus, an excellent weight balance is realized in the left-right direction, so that operability of the fastening tool 1 can be improved.

Further, as shown in FIG. 2, in regard to the front-rear direction, the trigger 151 provided in the upper end portion of the handle 15 is disposed between the nut 41 and the motor body 20. More specifically, in side view, at least a portion of the trigger 151 is located rearward of the rear end of the nut 41 and at least a portion of the trigger 151 is located forward of the front end of the motor body 20. It is noted that, in the present embodiment, in side view, the front end of the trigger 151 is located rearward of the rear end of the driven gear 411 and the rear end of the trigger 151 is located forward of the front end of the motor body 20. With such arrangement of the trigger 151 between the nut 41 and the motor body 20 which are relatively heavy, an excellent weigh balance is realized not only in the left-right direction but also in the front-rear direction, so that operability of the fastening tool 1 can be further improved.

Furthermore, as shown in FIG. 2, in regard to the front-rear direction, the nut 41 and the motor body 20 of the motor 2 are arranged in positions at least displaced from each other, toward the front and toward the rear, respectively. In the present embodiment, the nut 41 and the motor body 20 are spaced apart from each other in the front-rear direction. In other words, in side view, the front end of the motor body 20 is located rearward of the rear end of the nut 41. In this case, the trigger 151 can be disposed closer to the driving axis A1 above, so that operability of the fastening tool 1 can be further improved. Particularly, in the present embodiment, as shown in FIG. 6, the nut 41 and the motor 2 are arranged to partially overlap with each other when viewed from the rear. More specifically, the motor 2 is arranged to partially overlap with a lower portion of the nut 41. It is noted that the nut 41 herein includes the driven gear 411 provided on the nut 41. Therefore, it can also be said that the contour of the driven gear 411 partially overlaps with the contour of the stator 21 of the motor 2 when viewed from the rear. Thus, the housing 10 can be reduced in size in the up-down direction, and the trigger 151 can be reliably arranged closer to the driving axis A1.

The arrangement relation between the collection container 7, the driving axis A1 and the rotation axis A2 of the motor shaft 25 is as follows.

As shown in FIG. 6, the collection container 7 is configured such that the driving axis A1 and the rotation axis A2 of the motor shaft 25 are located within a region occupied by the collection container 7 when viewed from the rear. Thus, in the present embodiment, the volume of the collection container 7 can be secured within a reasonable range corresponding to a rear end portion of the housing 10.

Operation of the fastening tool 1 in the fastening process of the fastener 8 is now described.

As shown in FIGS. 2 and 5, the screw shaft 46 (the driving shaft 460) and the jaw assembly 63 are placed in the initial position at the start of the fastening process. A user inserts a portion of the pintail 813 of the fastener 8 into the jaw 65 through the insertion hole 615 of the nose tip 614 such that the jaw 65 loosely grips the pintail 813. The user further inserts the sleeve 851 through the mounting holes of the workpieces W to be fastened, up to a position where the flange 853 abuts on one side of the workpieces W.

When the trigger 151 is depressed by the user and the switch 152 is turned on, the controller 156 lights the LED of the illumination unit 115 and starts normal rotation driving of the motor 2. The rotating power of the motor 2 is transmitted to the nut 41 via the transmitting mechanism 3, which causes the nut 41 to rotate around the driving axis A1 and thereby causes the screw shaft 46 to move rearward from the initial position. Accordingly, the jaw assembly 63 connected to the screw shaft 46 is retracted rearward, so that the pintail 813 is also retracted rearward along the driving axis A1 while being firmly gripped by the jaw 65. At this time, a forward load is applied to the nut 41 and received by the thrust bearing 415.

Figure 7:
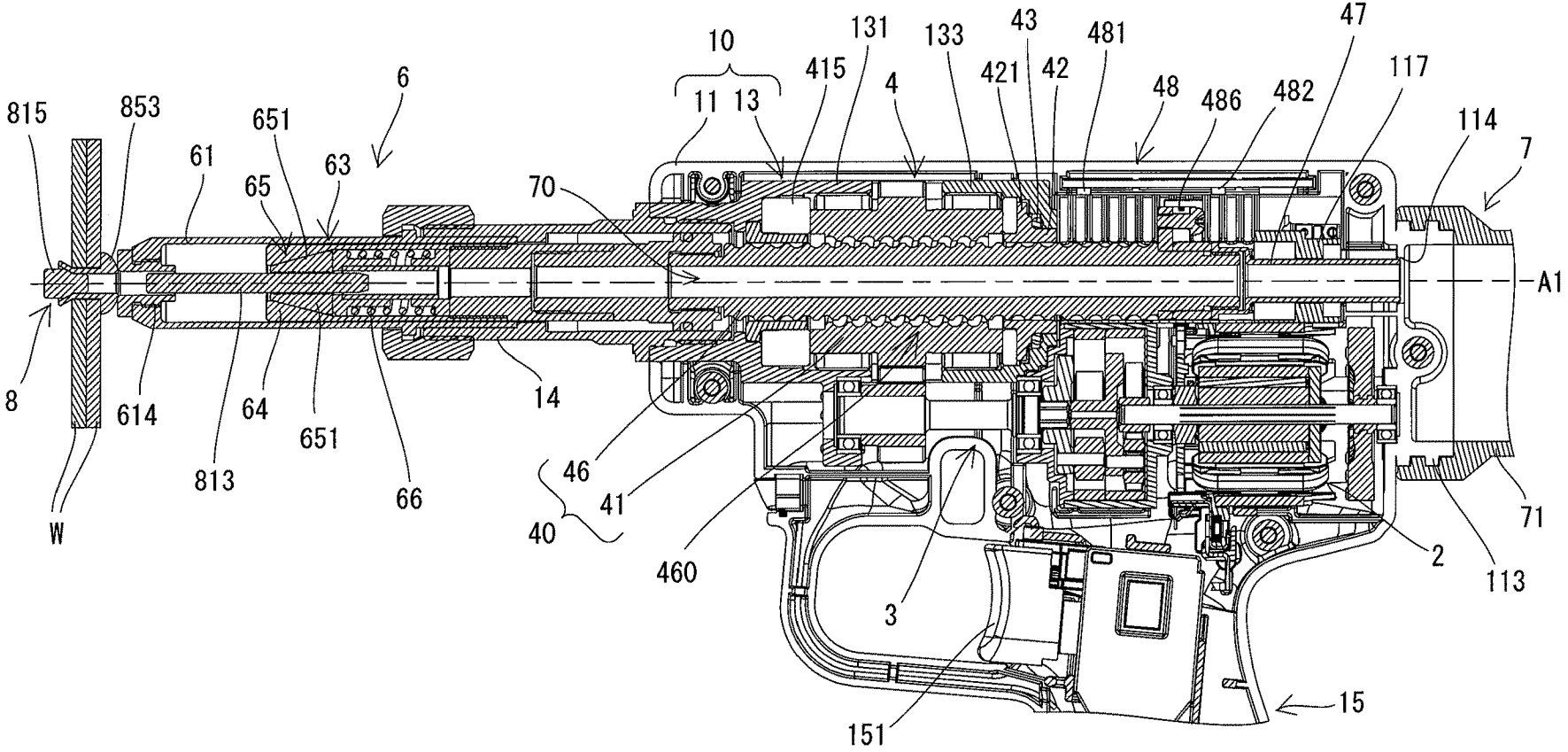
FIG. 7 is an explanatory drawing for illustrating a fastening process and a longitudinal sectional view showing the fastening tool when a driving shaft is located between an initial position and a stop position.

As shown in FIG. 7, when the screw shaft 46 is further moved rearward, the pin 81 is broken at the small-diameter part 812 (see FIG. 1) and the pintail 813 is separated from the fastener 8 before the screw shaft 46 reaches the stop position. When the pin 81 is broken, a strong force, which acts to move the nut 41 rearward relative to the inner housing 13, may be applied to the nut 41 on impact. Accordingly, rearward impact may be applied to the rear housing 133. In the present embodiment, however, the elastic member 43, which is disposed behind the nut 41 and between the nut 41 and the rear housing 133 in the front-rear direction, can cushion this impact so that the impact on the rear housing 133 can be effectively reduced. Thus, durability of the housing 10 including the rear housing 133 can be enhanced.

Particularly, in the present embodiment, the inner housing 13 which holds the nut 41 is formed by connecting the front housing 131 and the rear housing 133 in the front-rear direction. Such a structure can facilitate mounting the nut 41 to the inner housing 13. On the other hand, if connection between the rear housing 133 and the front housing 131 is loosened on impact when the pin 81 is broken, the nut 41 may be allowed to move in the front-rear direction. As a result, the screw shaft 46 and thus the jaw assembly 63 may be displaced in the front-rear direction and no longer be able to properly grip the pin 81. In the present embodiment, however, the above-described elastic member 43 can cushion impact on the rear housing 133 and thereby effectively suppress looseness of the connection between the rear housing 133 and the front housing 131.

Further, as shown in FIG. 3, in the present embodiment, the elastic member 43 is disposed between the flange 421 of the intervening member 42, which is disposed behind the nut 41, and the rear housing 133. With this structure, the elastic member 43 can be prevented from receiving a force around the driving axis A1 when the nut 41 is rotated, so that durability of the elastic member 43 can be enhanced. Further, the elastic member 43 is held between the flange 421 and the rear housing 133 in a pressurized state. Further, when the nut 41 moves rearward, the rear surface of the flange 421 may abut on the front surface of the rear end portion of the rear housing 133, so that the nut 41 is prevented from further moving rearward. Thus, the flange 421 of the intervening member 42 is configured to restrict the amount of rearward movement of the nut 41 relative to the rear housing 133 (in other words, the amount of compression of the elastic member 43). By this movement restriction by the flange 421, durability of the elastic member 43 can be enhanced while the elastic member 43 is kept in a state capable of reliably cushioning impact.

Figure 8:
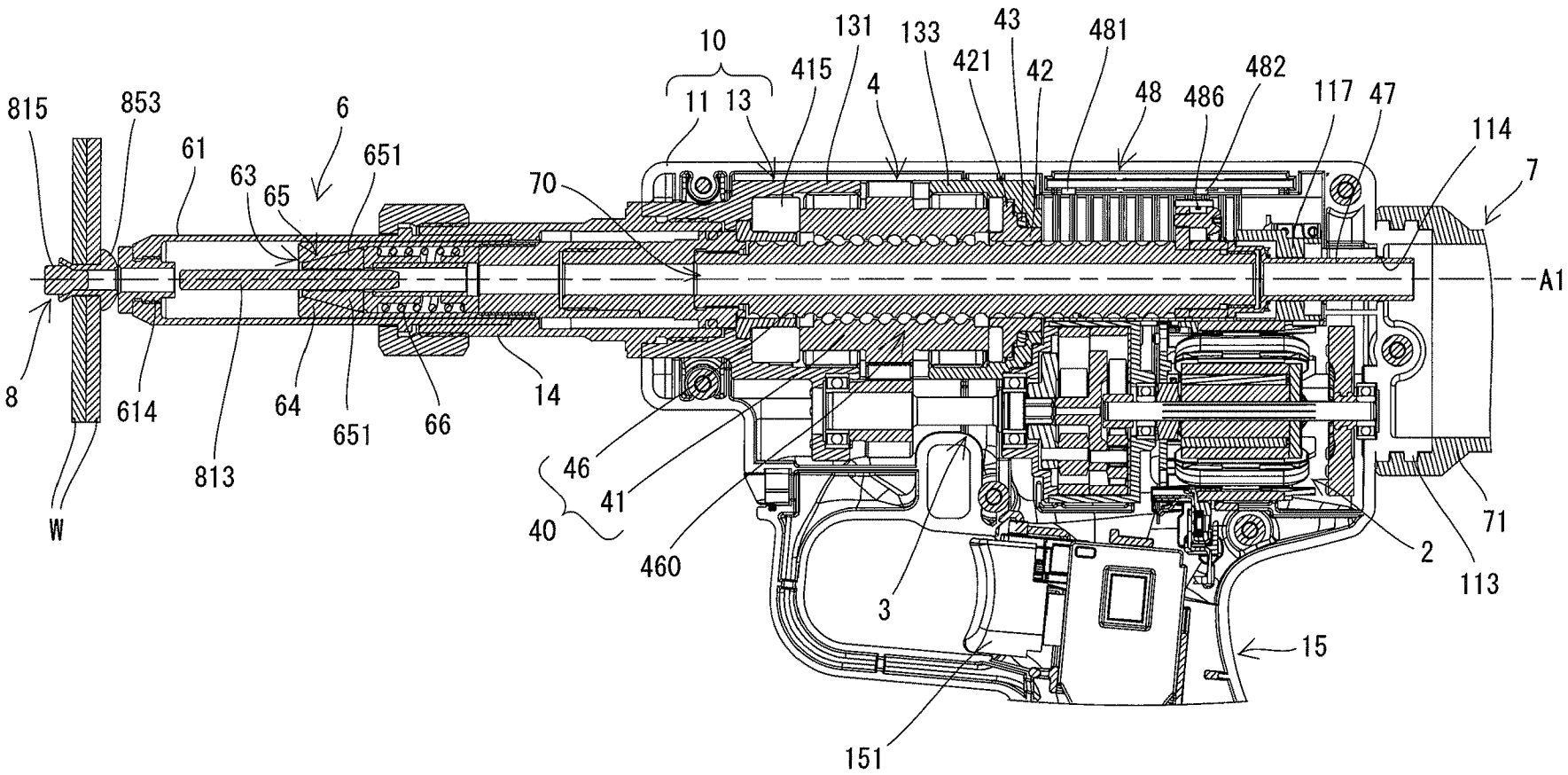
FIG. 8 is another explanatory drawing for illustrating the fastening process and a longitudinal sectional view showing the fastening tool when the driving shaft is located in the stop position.

After the pin 81 is broken, normal rotation driving of the motor 2 is continued and the screw shaft 46 is further moved rearward with the separated pintail 813 being gripped by the jaw 65. As shown in FIG. 8, when the screw shaft 46 reaches the stop position, the magnet 486 enters the detection range of the stop-position sensor 482. The controller 156 stops driving of the motor 2 in response to the output signal of the stop-position sensor 482 and thereby stops rearward movement of the screw shaft 46, which completes the process of fastening the workpieces W using the fastener 8.

Thereafter, the controller 156 turns off the LED of the illumination unit 115 when user's depressing operation of the trigger 150 is released and the switch 151 is turned off. Further, the controller 156 starts reverse rotation driving of the motor 20 and moves the screw shaft 46 forward until the controller 156 determines that the screw shaft 46 has reached the initial position, based on the output signal of the initial-position sensor 481. The screw shaft 46 and the jaw assembly 63 return to the initial position, so that the pintail 813 is allowed to be released from the jaw 65. The passage 70 allows passage of the pintail 813 which is pushed rearward by a pintail 813 of another fastener 8 in the next fastening process. The collection container 7 stores the pintail 813 which has reached the collection container 7 through the passage 70. In the present embodiment, since the passage 70 extends linearly along the driving axis A1, the pintail 813 can smoothly pass through the passage 70. Further, the collection container 7 which is removably attached to the rear end portion of the housing 10 can be easily attached/detached, compared with a case of the collection container to be disposed on an intermediate portion of the housing.

In the present embodiment, the screw shaft 46 returns to the initial position based on the detection result of the initial-position sensor 481. Therefore, the screw shaft 46 may be moved further forward beyond the initial position if the initial-position sensor 481 does not operate for some reason. In such a case, in the present embodiment, the rear end surface of the intervening member 42 which is flush with the rear end surface of the rear housing 133 abuts on a front end surface of the roller holding part 463 provided on the screw shaft 46, so that the screw shaft 46 and the jaw assembly 63 are prevented from further moving forward. In other words, the intervening member 42 functions as a stopper. Therefore, the possibility of damage to other parts (such as the inner housing 13 and the outer housing 11) can be reduced which may be caused by further forward movement of the screw shaft 46 and the jaw assembly 63 beyond the limit. It is noted that, in the present embodiment, the roller holding part 463 and the intervening member 42 are formed of iron having higher strength than plastic and aluminum. With such a structure, movement of the screw shaft 46 and the jaw assembly 63 can be effectively prevented while the possibility of damage to the roller holding part 463 and the intervening member 42 can be reduced.

In the present embodiment, operation of the fastening tool 1 is explained using the fastener 8 (blind rivet), which is an example of a tear-off type fastener. The fastening tool 1, however, also similarly operates in a case where a tear-off type fastener of the multi-piece swage type is used. Further, in a case where a shaft-retaining type fastener of a multi-piece swage type is used, the controller 156 may drive the motor 2 to normally rotate to move the screw shaft 46 rearward until an appropriate swaging force is applied to a collar of the fastener, and thereafter drive the motor 2 to reversely rotate to move the screw shaft 46 forward back to the initial position.

The above-described embodiment is a mere example of the invention and a fastening tool according to the present invention is not limited to the structure of the fastening tool 1. For example, the following modifications may be made. Further, one or more of these modifications may be employed independently or in combination with the fastening tool 1 of the above-described embodiment or the claimed invention.

In the above-described fastening tool 1, in a case where a tear-off type fastener like the fastener 8 is used, metal powder may be generated by breakage of the pin 81. The metal powder may stick to the separated pintail 813 and may be carried into the collection container 7 through the passage 70 and accumulated in the collection container 7 together with the pintail 813. This metal powder may stick to the outer peripheral surface of the rear end portion of the driving shaft 460 (the extension shaft 47) and enter the inside of the outer housing from the opening 114. Besides metal powder, sand may also enter from the opening 114. Therefore, the fastening tool 1 may be additionally provided with a dustproof structure to prevent various foreign matters (dust) such as metal powder and sand from entering a housing region for the driving mechanism 4 in the outer housing 11. Two examples of the dustproof structure which can be additionally provided in the fastening tool 1 are now described with reference to FIGS. 9 to 12.

The dustproof structure of a first modification is now described with reference to FIGS. 9 and 10.

Figure 9:
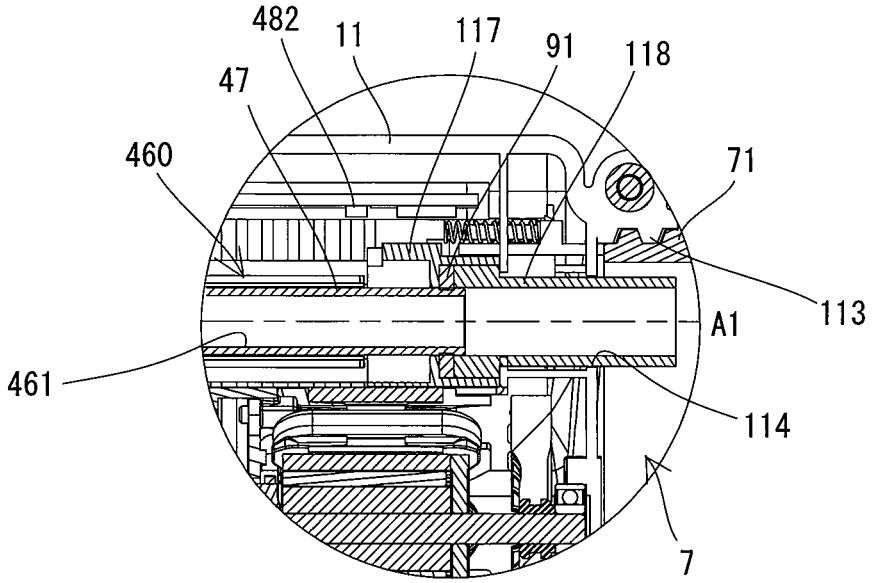
FIG. 9 is an explanatory drawing for illustrating the fastening tool having a dustproof member, showing a rear end portion of a housing when the driving shaft is located in the initial position.
Figure 10:
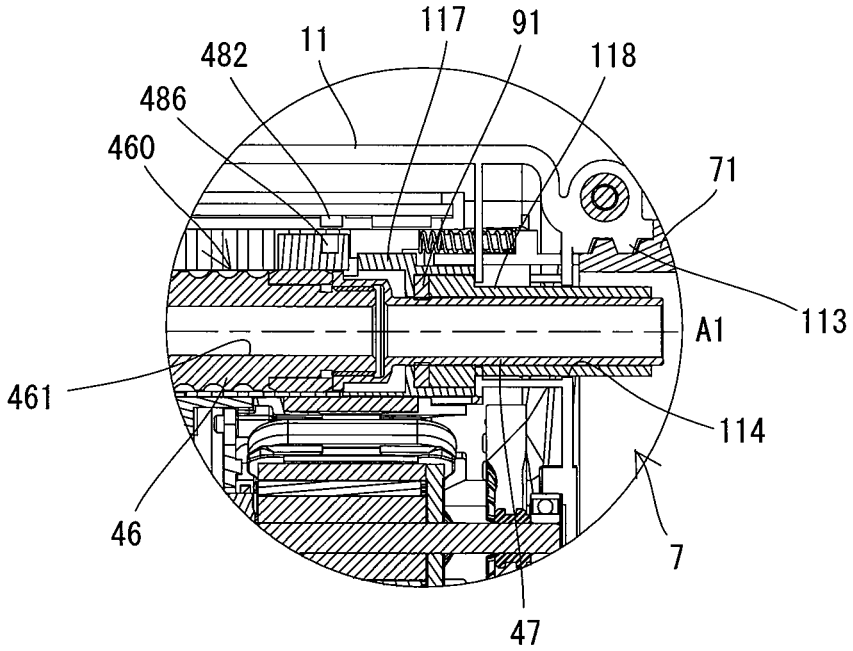
FIG. 10 is an explanatory drawing showing the rear end portion of the housing when the driving shaft is located in the stop position.

As shown in FIG. 9, in the first modification, a front end portion of a cylindrical extension sleeve 118 is fitted in a rear end portion of the guide sleeve 117 which is disposed within the rear end portion of the outer housing 11. The extension sleeve 118 coaxially extends with the guide sleeve 117, and a rear end portion of the extension sleeve 118 is inserted through the opening 114 to protrude into the container-connection part 113. In this modification, contrary to the above-described embodiment, a female thread is formed on an inner periphery of the container-connection part 113. The container-connection part 113 is configured to be threadedly engaged with a male thread formed on the cylindrical member 71. The inner diameter of the extension sleeve 118 is substantially equal to the outer diameter of the extension shaft 47. Further, a dustproof member 91 is disposed between the rear end portion of the guide sleeve 117 and a front end portion of the extension sleeve 118. In this modification, an annular felt member is employed as the dustproof member 91. The dustproof member 91 has an inner diameter slightly smaller than the outer diameter of the extension shaft 47 and an outer diameter substantially equal to the inner diameter of the rear end portion of the guide sleeve 117.

When the screw shaft 46 (the driving shaft 460) is placed in the initial position, as shown in FIG. 9, a rear end portion of the extension shaft 47 (the driving shaft 460) is inserted through the dustproof member 91 and located within the front end portion of the extension sleeve 118. Thus, the rear end of the extension shaft 47 (the driving shaft 460) is located rearward of a front end of the dustproof member 91. When the screw shaft 46 (the driving shaft 460) is moved rearward to the stop position, as shown in FIG. 10, the rear end of the extension shaft 47 (the driving shaft 460) is located in a position to protrude slightly rearward from the rear end of the extension sleeve 118.

The dustproof member 91 is disposed so as to slide on an outer peripheral surface of the extension shaft 47 while the screw shaft 46 (the driving shaft 460) moves in the front-rear direction between the initial position and the stop position. With this structure, the dustproof member 91 can prevent metal powder sticking to the outer peripheral surface of the rear end portion of the screw shaft 46 (the driving shaft 460) from entering an area forward of the dustproof member 91 when the rear end portion of the extension shaft 47 (the driving shaft 460) moves into the outer housing 11. Further, in a case other foreign matters (dust) enter through the opening 114 (the extension sleeve 118) when the collection container 7 is not attached, the dustproof member 91 can also prevent these foreign matters from entering the area forward of the dustproof member 91. Thus, the dustproof member 91 can prevent failures of the internal mechanisms (such as the driving mechanism 4, the transmitting mechanism 3, the motor 2 and the position-detecting mechanism 48) due to dust.

Figure 11:
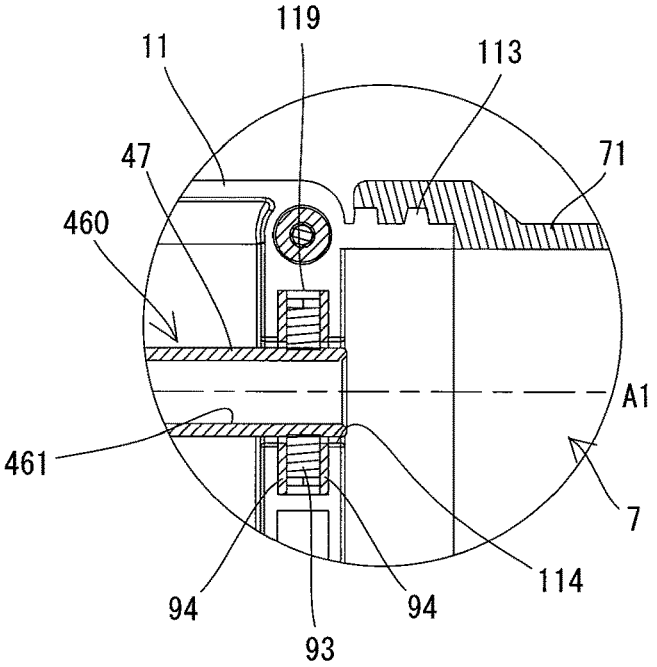
FIG. 11 is an explanatory drawing for illustrating the fastening tool having a different dustproof member, showing the rear end portion of the housing when the driving shaft is located in the initial position.
Figure 12:
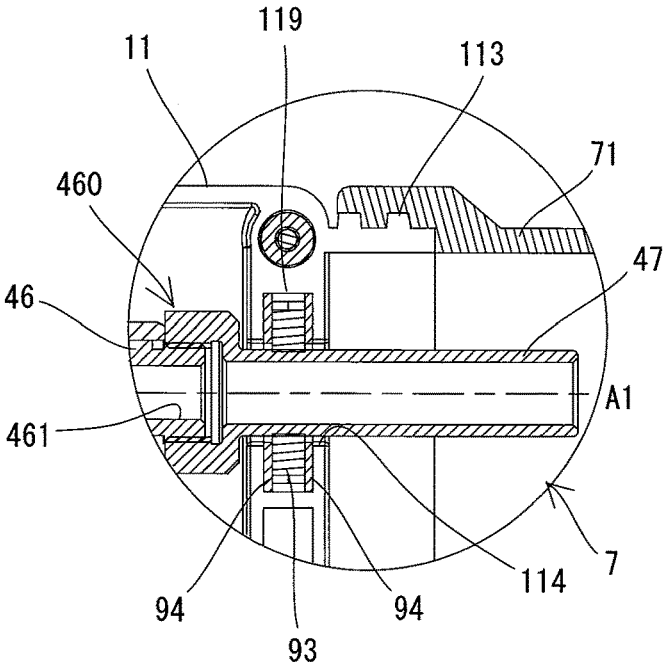
FIG. 12 is an explanatory drawing showing the rear end portion of the housing when the driving shaft is located in the stop position.

The dustproof structure of a second modification is now described with reference to FIGS. 11 and 12.

In the second modification, the guide sleeve 117 of the above-described embodiment is not provided in the rear end portion of the outer housing 11. Further, the extension shaft 47 is formed longer than that of the above-described embodiment. When the screw shaft 46 (the driving shaft 460) is placed in the initial position, as shown in FIG. 11, the rear end portion of the extension shaft 47 (the driving shaft 460) is inserted into the opening 114. At this time, the rear end of the extension shaft 47 (the driving shaft 460) is located in the vicinity of an open end (rear end) of the opening 114. Therefore, when the screw shaft 46 (the driving shaft 460) is moved rearward to the stop position, as shown in FIG. 12, the rear end of the extension shaft 47 (the driving shaft 460) is located in a position to protrude into the collection container 7.

In the present modification, an annular space 119 is formed to surround the opening 114 in a wall which forms the rear end portion of the outer housing 11. A dustproof member 93 is disposed in the space 119. The dustproof member 93 is disposed to be held from the front and rear between two annular washers 94 fitted in the space 119. In the present modification, an annular felt member is employed as the dustproof member 93. In the present modification, the dustproof member 93 has an inner diameter slightly smaller than the outer diameter of the extension shaft 47 and an outer diameter smaller than the outer diameter of the space 119. With this structure, ease of assembly can be enhanced, and even if the extension shaft 47 (the driving shaft 460) slightly tilts relative to the driving axis A1, the dustproof member 93 can be allowed to slightly move in the radial direction following the tilt.

Like the dustproof member 91, the dustproof member 93 is also disposed so as to slide on the outer peripheral surface of the extension shaft 47 while the screw shaft 46 (the driving shaft 460) is moved in the front-rear direction between the initial position and the stop position. With this structure, the dustproof member 93 can prevent metal powder sticking to the outer peripheral surface of the rear end portion of the screw shaft 46 (the driving shaft 460) and other foreign matters (dust) from entering an area forward of the dustproof member 93.

In the first and second modifications, the dustproof members 91, 93 formed as an annular felt member are described, but a material for the dustproof members 91, 93 is not limited to felt. Instead, rubber, nonwoven fabric, paper, and sponge, for example, may be employed. Further, the shape of the dustproof members 91, 93 is not particularly limited to the annular shape. For example, a brush-like member surrounding the outer peripheral surface of the movable member may be employed.

Other modifications are described below.

For example, in the above-described embodiment, the fastening tool 1 is configured to be used with a tear-off type fastener and a shaft-retaining type fastener by replacing the nose part 6. The fastening tool 1, however, may be exclusively designed for a tear-off type fastener. In this case, the thrust bearing 417 (see FIG. 3) disposed behind the nut 41 may be omitted. Further, the intervening member 42 may be disposed in abutment with the rear end surface of the nut 41 and the elastic member 43 may be held between the intervening member 42 and the rear end portion of the rear housing 133. In this case, it may be preferable that the intervening member 42 is arranged to be prevented from rotating around the driving axis A1 and receives the rear end surface of the nut 41 while allowing the nut 41 to rotate. The elastic member 43 is provided mainly to cushion impact which may be caused by breakage of a pin which is assumed in a fastening process of a tear-off type fastener. The elastic member 43 may, however, be provided in a fastening tool designed exclusively for a shaft-retaining type fastener, considering the possibility that a pin of the shaft-retaining type fastener may be broken for some reason.

Further, the structure of cushioning impact applied to the rear housing 133 via the nut 41 when the pin 81 is broken is not limited to the elastic member 43 (see FIG. 3) embodied as a rubber O-ring. In other words, the material and shape of the elastic member 43 may be appropriately changed. For example, a plurality of rubber members may be arranged in the circumferential direction around the driving axis A1. Elastic synthetic resin or a spring may be used in place of rubber. The structure of the intervening member 42 may also be appropriately changed. Further, the elastic member 43 may be disposed between the nut 41 and the rear housing 133, and the arrangement relation among the nut 41, the intervening member 42, the elastic member 43 and the rear housing 133 may be appropriately changed. For example, the elastic member 43 may be held from the front and rear between the nut 41 and the flange 421 of the intervening member 42. In this case, in order to secure durability of the elastic member 43, it may be preferable that the intervening member 42 is arranged to be rotatable around the driving axis A1 relative to the rear housing 133, and the elastic member 43 and the intervening member 42 are allowed to rotate together with the nut 41.

In the above-described embodiment, in a case where the screw shaft 46 is moved forward beyond the initial position, the roller holding part 463 fixed to the screw shaft 46 abuts on the rear end portion of the intervening member 42, so that the screw shaft 46 is prevented from further moving forward. In other words, the intervening member 42 is utilized as a movement-restricting part for the screw shaft 46. The movement-restricting part for the screw shaft 46, however, is not limited to the intervening member 42. Likewise, an abutment part on the screw shaft 46 side which abuts on the movement-restricting part is not limited to the roller holding part 463. It may be preferable that the movement-restricting part for the screw shaft 46 and the abutment part on the screw shaft 46 side are both formed of metal having relatively high strength.

The structures of the motor 2, the transmitting mechanism 3 and the driving mechanism 4 may also be appropriately changed. For example, the motor 2 may be a motor with a brush or an AC motor. The reduction ratio of the transmitting mechanism 3 as a whole and the number of the planetary-gear mechanisms of the planetary-gear reducer 31 may be appropriately changed. Further, in place of the ball-screw mechanism 40 which includes the nut 41 and the screw shaft 46 engaged with the nut 41 via the balls, a feed-screw mechanism can be employed which includes a nut having a female thread formed in its inner periphery and a screw shaft having a male thread formed in its outer periphery and threadedly engaged directly with the nut.

In the above-described embodiment, the position-detecting mechanism 48 including the initial-position sensor 481 and the stop-position sensor 482 is provided to detect that the screw shaft 46 (the driving shaft 460) and the jaw assembly 63 are located in specific positions (specifically, the initial position and the stop position). In place of the position-detecting mechanism 48, a position-detecting mechanism using a mechanical switch, not a magnetic sensor, may be employed. Further, in place of the initial-position sensor 481 and the stop-position sensor 482, a single sensor or switch may be employed. For example, a sensor or switch may be employed which is capable of detecting that the screw shaft 46 (the driving shaft 460) and the jaw assembly 63 are located in a specified origin position, which is different from the initial position or the stop position in the front-rear direction. In this case, the controller 156 may stop driving of the motor 2 based on the number of revolutions of the motor 2 or the number of driving pulses which are counted after detection of the screw shaft 46 located in the origin position, so that the screw shaft 46 (the driving shaft 460) and the jaw assembly 63 are placed in the specified initial position or stop position. It is noted that the number of revolutions of the motor 2 may be detected, for example, by a Hall IC.

The inner housing 13 need not include the front housing 131 and the rear housing 133. The inner housing 1 may include a left housing and a right housing which respectively cover left and right portions of the nut 41, or an upper housing and a lower housing which respectively cover upper and lower portions of the nut 41. Further, the housing 10 need not include the outer housing 11 and the inner housing 13, but may be configured as a single housing.

Correspondences between the features of the above-described embodiment and its modifications and the features of the invention are as follow. The fastener 8 is an example that corresponds to the "fastener" according to the present invention. The pin 81 and the body 85 are examples that correspond to the "pin" and the "cylindrical part", respectively, according to the present invention. The small-diameter part 812 and the pintail 813 are examples that correspond to the "small-diameter part" and the "pintail", respectively, according to the present invention. The workpiece W is an example that corresponds to the "workpiece" according to the present invention.

The fastening tool 1 is an example that corresponds to the "fastening tool" according to the present invention. The driving axis A1 is an example that corresponds to the "driving axis" according to the present invention. The housing 10 is an example that corresponds to the "housing" according to the present invention. The anvil 61 is an example that corresponds to the "fastener-abutment part" according to the present invention. The jaw assembly 63 is an example that corresponds to the "pin-gripping part" according to the present invention. The motor 2 is an example that corresponds to the "motor" according to the present invention. The stator 21, the rotor 22, the motor body 20 and the motor shaft 25 are examples that correspond to the "stator", the "rotor", the "motor body" and the "motor shaft", respectively, according to the present invention. The driving mechanism 4 is an example that corresponds to the "driving mechanism" according to the present invention. The handle 15 and the trigger 151 are examples that correspond to the "handle" and the "trigger", respectively, according to the present invention. The nut 41 and the driving shaft 460 are examples that correspond to the "rotary member" and the "movable member", respectively, according to the present invention. The rotation axis A2 is an example that corresponds to the "rotation axis of the motor shaft" according to the present invention.

The driven gear 411 is an example that corresponds to the "driven gear" according to the present invention. The intermediate shaft 33 and the nut-driving gear 35 are examples that correspond to the "intermediate shaft" and the "driving gear", respectively, according to the present invention. The passage 70 of the pintail 813 is an example that corresponds to the "pintail passage" according to the present invention. The collection container 7 is an example that corresponds to the "collection container" according to the present invention. Each of the dustproof members 91, 93 is an example that corresponds to the "dustproof member" according to the present invention. The illumination unit 115 is an example that corresponds to the "illumination device" according to the present invention. The trigger guard 153 is an example that corresponds to the "trigger-protection part" according to the present invention. The inner housing 13 is an example that corresponds to the "rotary-member-holding part" according to the present invention. The intervening member 42 is an example that corresponds to the "intervening member" according to the present invention. The initial-position sensor 481 of the position-detecting mechanism 48 is an example that corresponds to the "position-detecting mechanism" according to the present invention. The initial position is an example that corresponds to the "specified reference position" and the "specified initial position" according to the present invention.

Further, in view of the nature of the present invention, the above-described embodiment and its modifications, the following features are provided. The following features can be employed independently or in combination with the fastening tool 1 of the embodiment, the above-described modifications or the claimed invention.

(Aspect 1)

The handle may have a battery mounting part in a lower end portion of the handle, the battery mounting part being configured such that a battery is removably mounted thereto.

(Aspect 2)

The fastening tool may further comprise a control part configured to control operation of the driving mechanism by controlling driving of the motor, and the control part may be housed in a lower end portion of the handle.

(Aspect 3)

The rotary member may have a driven gear formed on its outer periphery, the driving mechanism may further include an intermediate shaft configured to be rotationally driven along with rotation of the motor shaft and having a driving gear engaged with the driven gear, and the rotary member and the motor may be arranged such that a contour of the driven gear partially overlaps with a contour of the motor when viewed from the rear.

Further, the following aspects 4 to 7 are provided in order to provide a technique which may help improve durability of a housing in a fastening tool.

(Aspect 4)

A fastening tool configured to fasten a workpiece via a fastener having a pin and a cylindrical part, the fastening tool comprising:

a housing extending in a front-rear direction of the fastening tool along a specified driving axis;

a fastener-abutment part held by a front end portion of the housing so as to be capable of abutting on the cylindrical part;

a pin-gripping part held to be movable in the front-rear direction along the driving axis relative to the fastener-abutment part and configured to grip a portion of the pin;

a motor; and a driving mechanism configured to be driven by power of the motor and configured to move the pin-gripping part rearward along the driving axis relative to the fastener-abutment part to pull the pin gripped by the pin-gripping part and deform the cylindrical part abutting on the fastener-abutment part, thereby fastening the workpiece via the fastener, wherein:

the housing includes a rotary-member-holding part, the driving mechanism includes:

a rotary member supported by the rotary-member-holding part so as to be rotatable around the driving axis while its movement in the front-rear direction is restricted, and configured to be rotationally driven by the power of the motor, and a movable member connected to the pin-gripping part and engaged with the rotary member so as to be movable in the front-rear direction along the driving axis while rotation around the driving axis is restricted, thereby linearly moving in the front-rear direction when the rotary member is rotationally driven, and the fastening tool further comprises an elastic member disposed behind the rotary member and between the rotary member and the rotary-member-holding part.

In the driving mechanism, the rotary member is held by the rotary-member-holding part while movement in the front-rear direction is restricted. However, in a case where the movable member moves the pin-gripping part rearward relative to the fastener-abutment part to pull the pin and the pin is broken, a strong force may act to relatively move the rotary member rearward on impact. Accordingly, rearward impact may be applied to a portion of the rotary-member-holding part which is arranged behind the rotary member. In the present aspect, the elastic member is disposed between the rotary member and the rotary-member-holding part of the housing. Therefore, the possibility of damage to the rotary-member-holding part can be effectively reduced by the elastic member cushioning the impact. Thus, durability of the housing including the rotary-member-holding part can be enhanced. Here, the elastic member may just be disposed behind the rotary member, and between the rotary member and the rotary-member-holding part. For example, the elastic member may be disposed in contact with the rotary member and the rotary-member-holding part, or disposed between another intervening member disposed between the rotary member and the rotary-member-holding part and one of the rotary member and the rotary-member-holding part. As the elastic member, for example, rubber, synthetic resin or a spring can be suitably employed, as long as it has elasticity.

(Aspect 5)

The fastening tool as defined in aspect 4, wherein the rotary-member-holding part is configured to hold the rotary member in the front-rear direction.

In other words, portions of the rotary-member-holding part may be arranged on the front and rear sides of the rotary member. With this structure, the rotary member can be more reliably restricted from moving in the front-rear direction during operation of the driving mechanism.

(Aspect 6)

The fastening tool as defined in aspect 5, wherein the rotary-member-holding part is formed by connecting a front member for holding the rotary member from the front and a rear member for holding the rotary member from the rear in the front-rear direction.

The rotary-member-holding part having such a structure can facilitate assembling. On the other hand, if rearward impact is applied to the rear member and connection between the rear member and the front member is loosened when the pin is broken, the rotary member may be allowed to move in the front-rear direction, so that the pin-gripping part may no longer be able to properly grip the pin. According to the present aspect, however, the elastic member can cushion impact and thereby effectively suppress looseness of the connection.

(Aspect 7)

The fastening tool as defined in any one of aspects 4 to 6, further comprising:

an intervening member disposed between the rotary member and the rotary-member-holding part in the front-rear direction, wherein:

the elastic member is disposed between the rotary member and the intervening member, or, between the intervening member and the rotary-member-holding part.

According to the present aspect, a force can be prevented from being directly applied to the elastic member around the driving axis, so that durability of the elastic member can be enhanced. In a case in which the elastic member is disposed between the rotary member and the intervening member, it may be preferable that the elastic member and the intervening member are arranged to rotate together with the rotary member. On the other hand, in a case in which the elastic member is disposed between the intervening member and the rotary-member-holding part, it may be preferable that only the rotary member rotates while rotation of the intervening member and the elastic member is restricted.

(Aspect 8)

The fastening tool as defined in aspect 7, further comprising:

a position-detecting mechanism configured to detect that the pin-gripping part is located in a specified reference position, wherein:

the driving mechanism is configured to move the pin-gripping part forward along the driving axis relative to the fastener-abutment part to be placed in a specified initial position based on a detection result of the detection device after the workpiece is fastened, and the intervening member has a movement-restricting part configured to abut on an abutment part of the movable member when the pin-gripping part connected to the movable member is moved forward beyond the initial position, thereby preventing the movable member and the pin-gripping part from further moving forward.

In the present aspect, when the pin-gripping part is moved forward beyond the initial position, the pin-gripping part can abut on the movement-restricting part of the intervening member and thus can be prevented from further moving forward. The reference position and the initial position may be the same or different. According to the present aspect, the movement-restricting part of the intervening member can prevent movement of the movable member and the pin-gripping part even if the pin-gripping part is moved beyond the initial position due to malfunction of the position-detecting mechanism. Therefore, the possibility of damage to other parts can be reduced which may be caused by further forward movement of the movable member and the pin-gripping part beyond the limit.

The rear end portion of the intervening member 42 is an example that corresponds to the "movement-restricting part" according to the present aspect. The roller holding part 463 is an example that corresponds to the "abutment part" according to the present aspect.

(Aspect 9)

The fastening tool as defined in any one of aspects 4 to 8, wherein:

the elastic member is held in a pressurized state, and the fastening tool further comprises a movement-amount-restriction part configured to restrict an amount of rearward movement of the rotary member relative to the rotary-member-holding part.

The elastic member "held in a pressurized state" may refer to the elastic member held in an elastically deformed state. For example, it may refer to a rubber elastic member held in slightly compressed state. According to the present aspect, the amount of rearward movement of the rotary member relative to the rotary-member-holding part, or the amount of elastic deformation of the elastic member can be restricted, so that durability of the elastic member can be enhanced while the elastic member can be kept in a state capable of reliably cushioning impact.

The flange 421 of the intervening member 42 is an example that corresponds to the "movement-amount-restriction part" according to the present aspect.

(Aspect 10)

The fastening tool as defined in any one of aspects 4 to 9, wherein:

the driving mechanism is configured to fasten the workpiece via the fastener and break the pin at a small-diameter part for breakage, and the movable member comprises a hollow member extending in the front-rear direction along the driving axis and having an internal passage which allows passage of a pintail separated by breakage of the pin.

According to the present aspect, provided is the fastening tool of a type which is capable of completing a fastening operation by breaking the pin and discharging the pintail separated by the breakage. In such a fastening tool, the elastic member can cushion impact and thereby effectively reduce the possibility of damage to the rotary-member-holding part.

(Aspect 11)

The fastening tool as defined in aspect 10, wherein:

a rear end portion of the housing has an opening formed to provide communication between the internal passage of the movable member and the outside of the housing, and is configured such that a collection container for the pintail discharged through the opening is removably attached thereto, the fastening tool further comprises a dustproof member held by the rear end portion of the housing and held in contact with an outer peripheral surface of a rear end portion of the movable member, and the dustproof member is disposed such that the movable member moves in the front-rear direction with the outer peripheral surface in sliding contact with the dustproof member, thereby preventing dust from entering an area forward of the dustproof member.

According to the present aspect, the pintail, which is discharged through the internal passage of the movable member and the opening of the housing, can be stored in the collection container. Metal powder generated by breakage of the pin may stick to the pintail and be carried into the collection container and easily accumulated therein. This metal powder may stick to the outer peripheral surface of the rear end portion of the movable member and enter the inside of the housing from the opening. Besides metal powder, sand may also enter from the opening. According to the present aspect, the dustproof member may be arranged such that the movable member moves in the front-rear direction with the outer peripheral surface in sliding contact with the dustproof member, and can prevent various foreign matters (dust) such as metal powder and sand from entering an area forward of the dustproof member. Thus, failures of the internal mechanisms due to dust can be prevented. The material of the dustproof member is not particularly limited, but, for example, felt, rubber, nonwoven fabric, paper and sponge may be employed. Further, the shape of the dustproof member is not particularly limited, but, for example, an annular member which surrounds the outer peripheral surface of the movable member, a brush-like member which surrounds the outer peripheral surface of the movable member, and the like may be employed.

DESCRIPTION OF THE NUMERALS

1: fastening tool, 10: housing, 11: outer housing, 111: roller guide, 113: container-connection part, 114: opening, 115: illumination unit, 117: guide sleeve, 118: extension sleeve, 119: space part, 13: inner housing, 131: front housing, 133: rear housing, 134: opening, 14: nose-holding member, 141: locking part, 145: fixing ring, 15: handle, 151: trigger, 152: switch, 153: trigger guard, 155: controller housing part, 156: controller, 157: operation part, 158: battery mounting part, 159: battery, 2: motor, 20: motor body, 21: stator, 23: rotor, 25: motor shaft, 251: bearing, 253: bearing, 27: fan, 3: transmitting mechanism, 30: speed-reducer housing, 31: planetary-gear reducer, 311: sun gear, 313: carrier, 33: intermediate shaft, 331: bearing, 333: bearing, 35: nut-driving gear, 4: driving mechanism, 40: ball-screw mechanism, 41: nut, 411: driven gear, 412, 413: radial bearing, 415, 417: thrust bearing, 42: intervening member, 421: flange, 43: elastic member, 46: screw shaft, 460: driving shaft, 461: through hole, 463: roller holding part, 464: roller, 47: extension shaft, 48: position-detecting mechanism, 481: initial-position sensor, 482: stop-position sensor, 485: magnet-holding part, 486: magnet, 49: connecting member, 491: O-ring, 495: through hole, 6: nose part, 61: anvil, 611: sleeve, 612: locking rib, 614: nose tip, 615: insertion hole, 63: jaw assembly, 64: jaw case, 641: connecting member, 65: jaw, 651: claw, 66: biasing spring, 67: spring-holding member, 671: first member, 672: sliding part, 675: second member, 7: collection container, 70: passage, 71: cylindrical member, 75: lid member, 8: fastener, 81: pin, 811: shaft part, 812: small-diameter part, 813: pintail, 815: head, 85: body, 851: sleeve, 853: flange, 91: dustproof member, 93: dustproof member, 94: washer, A1: driving axis, A2: rotation axis, VP: virtual plane, W: workpiece

The invention claimed is:

1. A fastening tool configured to fasten a workpiece via a fastener, the fastener having a pin and a cylindrical part, the fastening tool comprising:

a housing extending in a front-rear direction of the fastening tool along a driving axis;

a fastener-abutment part held by a front end portion of the housing so as to be capable of abutting the cylindrical part;

a pin-gripping part movable in the front-rear direction along the driving axis relative to the fastener-abutment part and configured to grip a portion of the pin;

a motor housed in the housing and including a motor body and a motor shaft, the motor body including a stator and a rotor, the motor shaft extending from the rotor;

a driving mechanism at least partially housed in the housing and configured to be driven by power of the motor and to move the pin-gripping part rearward along the driving axis relative to the fastener-abutment part to pull the pin gripped by the pin-gripping part and deform the cylindrical part abutting on the fastener-abutment part, thereby fastening the workpiece via the fastener; and a handle protruding downward from the housing in an up-down direction orthogonal to the front-rear direction, the handle having a trigger in an upper end portion of the handle and configured to be depressed by a user, wherein:

the driving mechanism includes:

a rotary member supported by a rotary member holding part of the housing so as to be rotatable around the driving axis while movement of the rotary member in the front-rear direction is restricted, the rotary member being configured to be rotationally driven by the power of the motor; and a movable member connected to the pin-gripping part and configured to be engaged with the rotary member so as to be movable in the front-rear direction along the driving axis while rotation of the movable member around the driving axis is restricted, and to linearly move in the front-rear direction when the rotary member is rotationally driven;

a rotation axis of the motor shaft is parallel to the driving axis and on a lower side of the driving axis;

a virtual plane including the driving axis and the rotation axis includes a center of the handle in a left-right direction orthogonal to the front-rear direction and the up-down direction;

the trigger is between the rotary member and the motor body in the front-rear direction;

the fastening tool further comprises:

an intervening member that is (1) a separate member from the rotary member and (2) between the rotary member and the rotary member holding part at a rear end of the rotary member in the front-rear direction; and an elastic member directly between and in contact with the rotary member holding part and the intervening member;

there is a distance between the intervening members and the rotary member holding part when the fastening tool is at rest; and the distance defines a maximum amount of compression of the elastic member when the fastening tool is in use.

2. The fastening tool as defined in claim 1, wherein the rotary member and the motor body are spaced apart from each other in the front-rear direction.

3. The fastening tool as defined in claim 2, wherein the rotary member and the motor partially overlap when viewed from the rear.

4. The fastening tool as defined in claim 1, wherein:

the rotary member has a driven gear on its outer periphery, the driving mechanism includes an intermediate shaft configured to be rotationally driven with rotation of the motor shaft and having a driving gear engaged with the driven gear, and the intermediate shaft is coaxial with the motor shaft.

5. The fastening tool as defined in claim 1, wherein:

the driving mechanism is configured to fasten the workpiece via the fastener and break the pin at a small-diameter part for breakage, and the fastening tool further comprises:

a pintail passage extending in the front-rear direction along the driving axis and configured to allow passage of a pintail separated by breakage of the pin; and a collection container for the pintail removably attached to a rear end portion of the housing and having an internal space communicating with a rear end of the pintail passage.

6. The fastening tool as defined in claim 5, wherein the collection container is configured such that the driving axis and the rotation axis of the motor shaft are located within a region occupied by the collection container when viewed from the rear.

7. The fastening tool as defined in claim 5, wherein:

the movable member is a hollow member having the pintail passage, the fastening tool further comprises a dustproof member held by the rear end portion of the housing and in contact with an outer peripheral surface of a rear end portion of the movable member, and the dustproof member is disposed configured such that the movable member moves in the front-rear direction with the outer peripheral surface in sliding contact with the dustproof member.

8. The fastening tool as defined in claim 1, further comprising:

an illumination device in a lower end portion of the housing and configured to irradiate light to a peripheral region of a front end portion of the fastener-abutment part; and a trigger-protection part extending from the lower end portion of the housing to a front end portion of the handle and configured to provide a space for a user's finger in front of the trigger, wherein the trigger-protection part has a passage for wiring for the illumination device.

9. The fastening tool as defined in claim 1, further comprising a position-detecting mechanism configured to detect that the pin-gripping part is in a reference position, wherein the driving mechanism is configured to move the pin-gripping part forward along the driving axis relative to the fastener-abutment part to an initial position based on a detection result of the detection device after the workpiece is fastened, and the intervening member is configured to abut an abutment part of the movable member when the pin-gripping part is moved forward beyond the initial position.

* * * * *